US008710742B2

(12) United States Patent
Chen et al.

(10) Patent No.: US 8,710,742 B2
(45) Date of Patent: Apr. 29, 2014

(54) METAL HALIDE LAMPS WITH FAST RUN-UP AND METHODS OF OPERATING THE SAME

(75) Inventors: Nancy H. Chen, North Andover, MA (US); James A. Avallon, Beverly, MA (US); Edgar G. Estupiñán, Peabody, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 240 days.

(21) Appl. No.: 13/176,964

(22) Filed: Jul. 6, 2011

(65) Prior Publication Data

US 2013/0009570 A1 Jan. 10, 2013

(51) Int. Cl.
*H01J 61/06* (2006.01)

(52) U.S. Cl.
USPC ..... 313/627; 313/637; 313/638; 313/643; 313/326

(58) Field of Classification Search
CPC ... H01J 61/827; H01J 61/0732; H01J 61/302; H01J 61/36; H01J 61/366
USPC ..... 313/285, 289, 332, 335, 571, 574, 313/620–624, 634, 641, 326, 627, 637–639, 313/643; 315/58, 61, 291, 209 R, 360
See application file for complete search history.

(56) References Cited

U.S. PATENT DOCUMENTS 3,675,068 A * 7/1972 Strauss ..... 313/623
5,479,065 A * 12/1995 Sugimoto et al. ..... 313/113
5,552,670 A * 9/1996 Heider et al. ..... 313/625
6,469,446 B1 10/2002 Stockwald
6,753,658 B2 * 6/2004 Caron ..... 315/209 R
6,774,547 B1 * 8/2004 Zaslavsky et al. ..... 313/285
6,798,139 B2 * 9/2004 Ramaiah et al. ..... 313/634
6,853,140 B2 2/2005 Lapatovich et al.
7,268,495 B2 * 9/2007 Rintamaki et al. ..... 313/640
7,474,057 B2 * 1/2009 Tambinl et al. ..... 313/639
7,589,477 B2 9/2009 Chen et al.
2003/0178942 A1 9/2003 Born
2003/0209986 A1 * 11/2003 Ishigami et al. ..... 313/641
2006/0290285 A1 12/2006 Lapatovich et al.

(Continued)

FOREIGN PATENT DOCUMENTS

WO 2009119612 A1 10/2009

OTHER PUBLICATIONS

Rice D W et al, Vaporization characteristics of zinc chloride, bromide and iodide, Journal of Physical Chemistry USA, vol. 72, No. 10, Oct. 1968, pp. 3361-3366, XP002680706.

(Continued)

*Primary Examiner* — Haiss Philogene
(74) *Attorney, Agent, or Firm* — Andrew Martin

(57) ABSTRACT

The present disclosure describes metal halide lamps having a discharge vessel, a discharge space, and at least one electrode extending into the discharge vessel in a sealed fashion so as to be in contact with the discharge space. A fill gas, at least one fill material, and optionally at least one volatile material are present in the discharge space. In some cases, the lamps can exhibit at least one of reduced run-up time, increased initial light output, and long life, while remaining useful for general lighting applications. Also described are methods for operating such metal halide lamps.

22 Claims, 30 Drawing Sheets

(56) References Cited

U.S. PATENT DOCUMENTS

| | | | | |
|---|---|---|---|---|
| 2007/0069655 | A1 | 3/2007 | Ishigami et al. | |
| 2007/0132396 | A1 | 6/2007 | Van Gennip | |
| 2007/0138931 | A1* | 6/2007 | Ramaiah | 313/333 |
| 2008/0278078 | A1 | 11/2008 | Uemura et al. | |
| 2008/0297052 | A1 | 12/2008 | Hebbinghaus et al. | |
| 2009/0102382 | A1 | 4/2009 | Werner | |
| 2009/0295287 | A1 | 12/2009 | Tsuda | |

OTHER PUBLICATIONS

Wei. et al., "Dysprosium Oxide Ceramic Arc Tube for HID Lamps," J. Phys. D: Appl. Phys. vol. 41, No. 14 (Jul. 21, 2008).

* cited by examiner

Fig. 1 Voltage vs. time elapsed during run-up of lamps containing 6 bar Xe and 1mg of a volatile additive.

METAL HALIDE LAMPS WITH FAST RUN-UP AND METHODS OF OPERATING THE SAME

BACKGROUND

Metal halide lamps for general lighting are efficient and produce high quality white light. However, such lamps frequently require substantial time after ignition to warm up to nominal light output and steady state operation. Indeed, such lamps can require as much as several minutes from ignition to reach full light output, depending on the lamp type.

Metal halide lamps may be run-up more quickly to full light output by temporarily overpowering the lamp during the run-up process. While the temporary application of high current is not necessarily a problem, it can lead to thermal shock, electrode damage, and wall blackening. This is because conventional metal halide lamps are designed to operate with a relatively high steady state voltage and a relatively low steady state current at a nominal power P, where P=I*V. As a result, the electrodes in conventional metal halide lamps are not appropriately sized or otherwise configured to conduct the high current applied while the lamp is overpowered, leading to reduced lamp lifetime, lumen maintenance, etc.

The above issues are exemplified in various automotive (quartz) metal halide lamps. In such lamps, high current is applied during run-up to increase deposited power, which causes the lamp temperature to quickly rise. As the lamp temperature rises, the metal halide fill begins to evaporate, further increasing lamp voltage and deposited power. Although this run-up process allows automotive metal halide lamps to run-up relatively quickly, such lamps are not rated for long life, and do not permit the use of certain fills for higher quality light. Accordingly, such lamps are not ideal for general lighting applications, where rapid run-up, long lamp lifetime, and high quality photometric output are desired.

BRIEF DESCRIPTION OF THE DRAWINGS

Reference is now made to the detailed description, which should be read in conjunction with the following figures. Wherever possible, the same reference numbers are used throughout the drawings to refer to the same or like parts.

DETAILED DESCRIPTION

Figure 1:
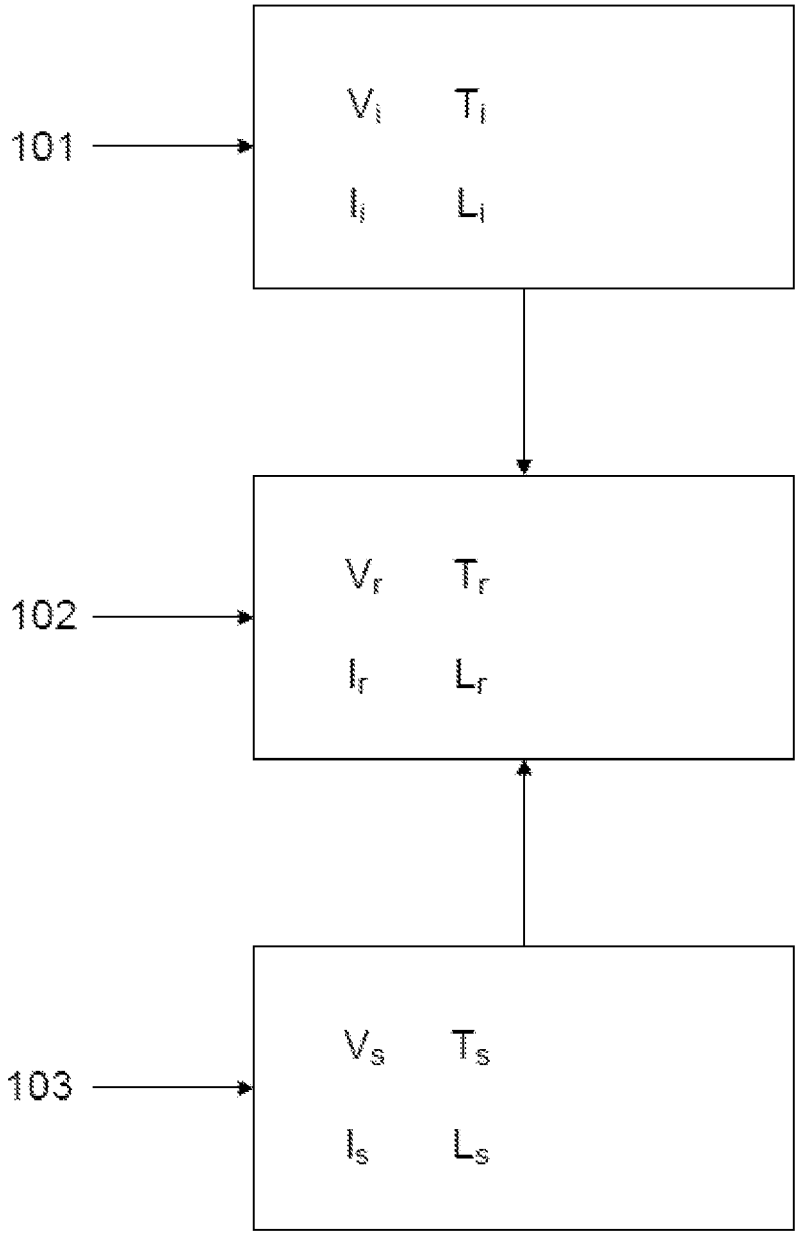
FIG. 1 is a block diagram identifying three steps in the operation of a metal halide lamp, as well as certain electrical parameters of interest during each step.

For the purpose of the present disclosure, the following terms are defined as follows.

"Nominal" or "nominally" when referring to an amount means a designated or theoretical amount that may vary from the actual amount.

"Relative light output" means the light output (in lumens) of a lamp, relative to the light output of the lamp at steady state operation at the rated or nominal lamp power.

"Run-up" means the time period after ignition of a metal halide lamp and before the time when the lamp reaches steady state operation.

"Run-up time" means the time required for a lamp to reach full light output, i.e., when the relative light output of a metal halide lamp equals 1.

"Steady state" and "steady state operation" mean the condition at which a metal halide lamp has reached nominal operating temperature ($T_n$) and nominal light output ($L_n$) at a nominal power $P_{req}$ (in watts).

"Substantially" and "about" when referring to an amount means+/−5% of the designated amount.

In the present disclosure, the following symbols have the following meaning.

$V_i$=voltage (in volts) of a metal halide lamp immediately after ignition (e.g., about 1 second after ignition).

$T_i$=temperature of a metal halide lamp (in centigrade) at ignition.

$L_i$=light output of a metal halide lamp (in lumens) immediately after ignition (e.g., about 1 second after ignition).

$V_r$=voltage during run-up, i.e., the voltage (in volts) exhibited by a metal halide lamp while the lamp is run-up to steady state operation. Generally, $V_r$ increases as the temperature of the metal halide lamp increases during run-up. This is due to vaporization of the materials in the discharge space of the lamp, e.g., the fill or other materials.

$L_r$=light output (in lumens) of a metal halide lamp during run-up. Generally, $L_r$ increases as the temperature $T_r$ (described below) of the metal halide lamp increases. This is because as temperature increases, lamp efficacy increases and $V_r$ increases, which in turn leads to increased deposited power to the lamp for a fixed or limited run-up current, and elevated light output.

$T_r$=temperature at run-up, i.e., the temperature or range of temperatures of a metal halide lamp during run-up. Generally, $T_r$ increases with time during run-up, as electrical energy deposited during run-up is converted into light and heat.

$I_r$=current during run-up, i.e., the current (in amperes) applied to a metal halide lamp during run-up. Depending on the lamp configuration and run-up method, $I_r$ can be fixed or variable. For example $I_r$ may be equal to, less than, or greater than the nominal steady state current $I_s$ (described below). Further, $I_r$ may vary in response to a change in $V_r$ during run-up, and/or in response to a change in lamp efficacy during run-up.

$V_s$=nominal steady state voltage (in volts) of a metal halide lamp.

$I_s$=nominal steady state current (in amperes) of a metal halide lamp.

$T_s$=nominal operating temperature (in centigrade) at steady state of a metal halide lamp.

$L_n$=nominal light output (in lumens) at steady state of a metal halide lamp.

$P_{req}$=nominal power (in volt*amps) required to maintain a metal halide lamp at steady state and at nominal $L_n$ and $T_s$. $P_{req}=I_s*V_s$.

Metal halide lamps generally include a discharge vessel, a discharge space, and at least one electrode assembly extending into the discharge space. Also present in the discharge space is at least one fill gas and at least one fill material. Typically, such lamps are operated by igniting an arc between the electrodes, running-up the lamp to steady state operation, and maintaining the lamp at steady state at a nominal $P_{req}$. These steps are graphically illustrated in FIG. 1, with box 101 corresponding to ignition, box 102 corresponding to run-up, and box 103 corresponding to steady state operation. FIG. 1 also identifies various electrical characteristics of interest at each of these steps.

At or just prior to ignition, a metal halide lamp is at a relatively low temperature condition, e.g., room temperature. Because the fill material generally has a low vapor pressure at room/ignition temperature, it is present in a condensed (e.g., liquid or solid) form within the discharge space. As a result, the gaseous material in the discharge space at or just prior to ignition is primarily composed of the fill gas. Accordingly, voltage $V_i$ of the lamp at ignition is quite low. For example, $V_i$ may be greater than 0 to about 35 volts, such as greater than 0 to about 30 volts, about 10 to about 30 volts, or even about 10 to about 20 volts. Of course, metal halide lamps having other $V_i$ values are possible, and are envisioned by the present disclosure.

After ignition, power ($I_r*V_r$) is deposited in the lamp. Shortly after ignition, the deposited power is low because voltage $V_r$ approximates voltage $V_i$, which as previously noted is quite low. Moreover, $I_r$ is limited by the current carrying capacity of the lamp electrodes. If $I_r$ is too high during run-up or if $I_r$ exceeding the current carrying capacity of the lamp electrodes is applied repeatedly or for too long a period of time, the lamp electrodes or other components may overheat. This can result in damage to the electrodes or other components of the lamp, as previously described.

As power is deposited during run-up it is converted to light and heat. As a result, temperature $T_r$ increases and the fill material of the lamp begins to evaporate. As the fill evaporates, voltage $V_r$ increases, thereby increasing deposited power and further increasing $T_r$. As time passes, the run-up process continues to accelerate until the lamp reaches steady state.

Upon reaching steady state, power $P_{req}$ is applied to the lamp at a voltage $V_s$ and current $I_s$ that is appropriate to maintain the lamp at steady state with a nominal light output $L_n$ and nominal temperature $T_s$. As noted above, the value of $P_{req}$ is determined by desired $L_n$ and $T_s$, and is achieved by controlling voltage $V_s$ and current $I_s$.

Conventional metal halide lamps are designed for steady state operation under a relatively high voltage ($V_s$), relatively low current ($I_s$) condition. Indeed, known metal halide lamps are often designed such that $V_s$ approximates the input voltage to the lamp (e.g., 120V). Thus, presently available metal halide lamps frequently have a $V_s$ ranging from 70-100V or more. Due to this drive towards high $V_s$, conventional metal halide lamps have a relatively low $I_s$ at a nominal $P_{req}$ ($P_{req}=I_s*V_s$).

Because they operate at high $V_s$ and low $I_s$, conventional metal halide lamps have electrodes with correspondingly low current ratings (and hence, current carrying capacity). As a result, the amount of power that can be applied during runup may be limited, and an extended period of time may be required to run-up such lamps from ignition to steady state. Indeed, run-up times of up to several minutes are typically common in conventional metal halide lamps. These extended run-up times are largely associated with the time required to raise the lamp temperature sufficiently to begin evaporating the metal halide salts in the fill.

One method of decreasing run-up time is to "overpower" the lamp during run-up by temporarily increasing current $I_r$, and hence, deposited power. However, presently used run-up control algorithms are formulated assuming that run-up current $I_r$ is limited by a maximum tolerable electrode current, to avoid melt back of the tip, for example. Moreover, because conventional metal halide lamp electrodes are designed to operate at steady state under a high $V_s$ condition, $I_s$ is correspondingly small, meaning that such lamps are generally incompatible with the electrodes that would be needed to support increases to run-up current $I_r$ and deposited power during run-up.

Another method for decreasing run-up time is to add at least one volatile material to the discharge space of a metal halide lamp. Because these volatile materials have high vapor pressure relative to the components of the fill material, they evaporate quickly after ignition, thereby bolstering $V_r$ and increasing deposited power during run-up.

Because conventional metal halide lamps are designed to operate at high $V_s$, the addition of volatile materials is generally viewed as a favorable method of reducing run-up time of the lamp. This is because in addition to increasing $V_r$ during run-up, the added volatile materials also contribute to (i.e., increase) $V_s$. Indeed, with the addition of a volatile material, the voltage at steady state ($V_r$) of conventional metal lamps is generally greater than 3.33 times the voltage at ignition ($V_i$) of the lamp. As a result, prior investigations into the addition of volatile materials have focused on the addition of such materials in quantities that are compatible with the perceived advantages of running a metal halide lamp at steady state under a relatively high $V_r$, relatively low $I_r$ condition, and the electrode configurations compatible with such designs. This research has not recognized the benefits of operating a metal halide discharge lamp at steady state under a relatively low $V_s$, relatively high $I_s$ condition, either with or without at least one volatile material in the discharge space.

Accordingly, one aspect of the present disclosure relates to metal halide lamps that are designed for steady state operation at a relatively low $V_s$, relatively high $I_s$ condition. As described below, such lamps can exhibit one or more benefits over conventional lamp designs, including decreased run up time, increased light output at ignition and during run-up, and reasonable lumen maintenance. In addition, and as described in detail below, such lamps can be free or substantially free of mercury.

Figure 2:
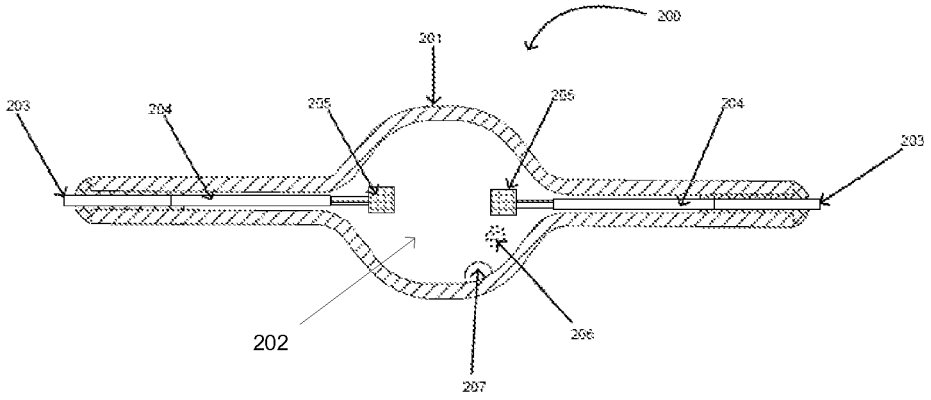
FIG. 2 illustrates one non-limiting configuration of a metal halide lamp according to the present disclosure.

As a non-limiting example of the configuration of a metal halide lamp in accordance with the present disclosure, reference is made to FIG. 2. As shown, metal halide lamp 200 includes discharge vessel 201. Discharge space 202 is present within discharge vessel 201. Electrode assemblies 203 extend into discharge vessel 201 in a sealed fashion so as to be in contact with discharge space 202. Electrode assemblies 203 include feedthroughs 204 and electrode tips 205. Fill gas 206 and fill material 207 are present within discharge space 202.

While FIG. 2 is demonstrative of one configuration of a metal halide lamp in accordance with the present disclosure, it should be understood that the shape, size, and general layout of the illustrated components is exemplary only, and such components can be modified in accordance with known principles in the art. For example, discharge space 202 is illustrated in FIG. 2 as having a bulbous, spheroidal shape. However, discharge space 202 may be configured to have any shape suitable for use in a metal halide lamp. For example, discharge space may be spherical, spheroidal, tubular, rectangular, oblong or of another geometric or irregular shape. It should also be understood that FIG. 2 does not illustrate other components commonly found in metal halide lamps, e.g., a base, an outer tube, a startup electrode, etc.

The discharge vessels used in the metal halide lamps of the present disclosure may be manufactured from any appropriate light transmissive material. As non-limiting examples of such materials, mention is made of quartz, sapphire, polycrystalline alumina, light transmissive ceramics, combinations thereof, and other suitable materials. In some embodiments, discharge vessel 201 is a light transmissive ceramic, such as polycrystalline alumina, sapphire, yttria, aluminum nitride, and aluminum oxynitride.

The electrode assemblies used in the metal halide lamps described herein may be manufactured from any material that is suitable for use in the formation of a metal halide lamp electrode. Non-limiting examples of such materials include iridium, tantalum, tungsten, tungsten doped with potassium, tungsten doped with thorium and/or thorium dioxide, molybdenum, niobium, mixtures, combinations and alloys thereof. Other non-limiting examples of suitable electrode materials include cermets, such as alumina molybdenum cermets. As illustrated in FIG. 2, electrode assemblies 203 are sealed to discharge vessel 201, e.g., by a glass frit or another suitable material (not labeled) so as to contain fill gas 206 and fill material 207 in discharge space 202. The electrode assemblies may be constructed so as to operate with either AC or DC current.

The electrode assemblies may also be designed so as to support the steady state operation of a metal halide lamp under a relatively low $V_s$, relatively high $I_s$ condition. That is, the electrode assemblies may be configured such that the electrode tip has a current rating greater than or equal to about the current $I_s$ applied during the steady state operation of the lamp. As used herein, the term "current rating" refers to the current, as defined by the expression $C=P/V_s$, that an electrode or other part is designed to run at during steady state operation of a lamp, where C is the current rating in amperes, P is the nominal power of a lamp, and $V_s$ is the steady state voltage. Thus, for a lamp having a nominal power rating of 100 W and a steady state voltage of 20V, C=5 amperes. With this in mind, the present disclosure contemplates the use of lamps having a wide range of nominal power ratings. For example, lamps with a nominal power rating of about 12.5 W, about 25 W, about 40 W, about 50 W, about 60 W, about 75 W, about 87.5 W, about 100 W, about 125 W, about 150 W, or higher can be used. Moreover, the steady state voltage $V_s$ of such lamps may be below, above, or within any of the $V_s$ ranges specified in the present disclosure.

Accordingly, lamps having electrodes and/or other parts configured with a wide range of current ratings are envisioned. For example, electrodes with current ratings ranging from about 0.25 to about 10 A, such as about 0.5 to about 7.5 A, from about 1 to about 6 A, or even from about 2 to about 5 A may be used. Alternatively or additionally, lamps having a current rating greater than or equal to about P/120V, such as greater than or equal to about P/85V, P/75V, P/60V, P/50V, P/40V, P/35V, P/30V, P/25V, or even greater than or equal to about P/20V may be used, where P corresponds to any nominal power rating specified in this application (e.g., about 25 W, 40 W, 50 W, 60 W, 75 W, 100 W, 150 W, etc.).

Of course, electrodes with current ratings above, below or within any of the aforementioned ranges may also be used, and are envisioned by the present disclosure. For the purpose of clarity, it is noted that the term "current rating" is distinct from the term "current carrying capacity," which refers to the amount of current that an electrode or part can withstand on a temporary basis such as during run-up, where $I_r$ can be one or a several times greater than $I_s$. In some cases, the electrode assemblies are designed to have a current carrying capacity ranging from about 1 to about 10 times $I_s$, such as about 1 to about 7.5 times $I_s$, about 1.5 to about 6 times $I_s$, about 2 to about 5 times $I_s$, or even from about 2 to about 4 times $I_s$. In one non-limiting embodiment of the present disclosure, the electrode assemblies have a current carrying capacity ranging from about 3 to about 4 times $I_s$.

The electrode assemblies may be configured such that the current rating $C_2$ of the feedthrough is the same or different from the current rating $C_1$ of the electrode tip. Further, $C_2$ may be less than, equal to, or greater than $I_s$. Thus, the present disclosure contemplates metal halide lamps in which both the electrode tip and feedthrough are sized or otherwise configured such that the current rating $C_1$ and the current rating $C_2$ are greater than or equal to $I_s$. Alternatively, the metal halide lamps may include electrodes wherein $C_2$ is less than $I_s$, and $C_1$ is greater than $I_s$. In some embodiments, $C_1$ and $C_2$ are equal or substantially equal, and are both greater than $I_s$. For example, $C_1$ may correspond to one of the current rating specified above (e.g., P/50V), whereas $C_2$ may correspond to another of the current ratings specified above (e.g., P/85V).

In circumstances where $C_1$ substantially differs from $C_2$ (i.e., $C_1$ and $C_2$ differ by greater than or equal to 5%), the electrode is considered as having a "hybrid" configuration. Non-limiting examples of such "hybrid" electrodes include electrodes in which $C_1$ is greater than or equal to about 1.5 times $C_2$, about 1.75 times $C_2$, about 2.0 times $C_2$, or even about 2.5 times $C_2$. Of course, hybrid electrode configurations with $C_1$ and/or $C_2$ values that are above, below, or between any of the aforementioned endpoints are permitted, and are envisioned by the present disclosure.

As further non-limiting examples of "hybrid" electrodes, mention is made of electrodes formed by welding a feedthrough with current rating typical for a 35 W lamp to an electrode tip with current rating typical for a 70 W lamp, and electrodes formed by welding a feedthrough with current rating typical for a 20 W lamp to an electrode tip with current rating typical for a 35 W lamp. Of course, the precise current ratings of the feedthrough and electrode tip are not limiting, and can vary widely depending on the application, desired light output, etc. of the lamp. Alternatively or additionally, the feedthroughs described herein may be appropriately sized for a nominal power rating specified in this application (e.g., about 25 W, 40 W, 50 W, 60 W, 75 W, 100 W, 150 W, etc.).

Thus for example, the electrode assemblies described herein may be formed by combining a feedthrough sized appropriately for a lamp having a nominal power rating with an electrode tip having a current rating that is greater than the nominal steady state current ($I_n$) traditionally required for a lamp of that power rating. That is, the nominal power rating of a traditional metal halide lamp ($P_n$) may be defined by the expression $P_n=I_n\times V_n$, where $I_n$ is the nominal steady state current, and $V_n$ is nominal steady state voltage, and $V_n$ is 60V or higher. Accordingly, if a traditional lamp has a nominal power rating ($P_n$) of 100 W and a nominal steady state voltage ($V_n$) of 90V, the nominal steady state current ($I_n$) for such a lamp would be about 1.1 A. Meaning that in a traditional lamp, both the electrode tip and feedthrough would be sized or otherwise designed to support an $I_n$ of about 1.1 A at a $V_n$ of about 90V.

In contrast, some of the lamps of the present disclosure are designed with electrode assemblies formed by combining a feedthrough that is sized appropriately for the nominal power of the lamp, using the $P_n=I_n\times V_n$ relationship described above (wherein $V_n$ is ≥60V), with an electrode tip having a current rating greater than $I_n$. For example, the electrode assemblies may be formed by combining a feedthrough sized appropriately using $P_n=I_n\times V_n$ with an electrode tip having a current rating sufficient to support $I_s$, as defined by the expression $I_s=P_{req}/V_s$, where $V_s$ is as defined above (i.e., as less than or equal to about 50V), and $P_{req}$ equals $P_n$. In some cases, the electrode assemblies described herein are formed by combining a feedthrough appropriately sized using $P_n=I_n\times V_n$ with an electrode tip having a current rating greater than or equal to about 1.5 times $I_n$, such as greater than or equal to about 2.0 times $I_n$, greater than or equal to about 2.5 times $I_n$, or even greater than or equal to about 5 times $I_n$.

The electrode assemblies of the present disclosure may also be configured in a so-called "conventional" configuration, wherein the electrode tip and feedthrough have the same or substantially the same current rating (i.e., $C_1$ and $C_2$ differ by less than or equal to about 5%). In these circumstances, the electrode assemblies and components thereof may be selected based on other design parameters of the lamp, such as the interior diameter of a capillary through which the electrode assembly is inserted during lamp construction.

The electrode tips used in the lamps according to the present disclosure can be of any configuration suitable for use in a metal halide lamp. As non-limiting examples of suitable electrode tip configurations, mention is made of so-called WUW tips (i.e., so called, wound-break-wound tips), solid tips, wound (non WUW) tips, and coiled tips.

The fill gas may be any gas that is suitable for use in a metal halide lamp. For example, the fill gas may be chosen from inert gases such as helium, neon, argon, krypton, xenon, and mixtures thereof. In some embodiments, the fill gas is chosen from argon, krypton, xenon and mixtures thereof.

The fill material is formulated to emit a desired spectrum of light during steady state operation of a metal halide lamp. Generally, the fill material includes at least one first metal halide such as a fluoride, chloride, bromide, iodide, etc. that is excitable to emission of light, e.g., upon application of electric power. In some embodiments, the at least one first metal halide includes at least one iodide. Non-limiting examples of suitable first metal halides include the halides (iodides, chlorides, etc.) of aluminum, calcium, cerium, cesium, cobalt, dysprosium, iron, gallium, hafnium, holmium indium, neodymium, praseodymium, scandium, sodium, thalium, thulium, tin, zinc, and combinations thereof. In some embodiments the first metal halide includes at least one iodide of sodium (e.g., NaI), dysprosium (e.g., $DyI_3$), cerium (e.g., $CeI_3$), thulium (e.g., $TmI_3$), Holmium (e.g., $HoI_3$), Calcium (e.g., $CaI_3$) and combinations thereof.

As used herein in the context of the fill material, the term "relatively low vapor pressure" means that the fill material has a vapor pressure lower than the vapor pressure of a volatile material (described below) that may also be present within the discharge chamber in addition to the fill material. In cases where multiple volatile materials are present in the discharge chamber, the fill material is considered as having a relatively low vapor pressure so long as the highest vapor pressure of any volatile material in the discharge space exceeds the highest vapor pressure of any metal halide components of the fill material. In some embodiments, the fill material is formulated such that all of its metal halide components have a vapor pressure that is lower than the lowest vapor pressure of the volatile materials in the discharge space.

As mentioned above, the metal halide lamps of the present disclosure may also include at least one volatile material in the discharge space. The at least one volatile material can be chosen from materials having a high vapor pressure, relative to the at least one first metal halide of the fill material. As non-limiting examples of suitable volatile materials, mention is made of mercury, at least one second metal halide, and combinations thereof. Examples of suitable second metal halides include, but are not limited to halides of tin, gallium, aluminum, hafnium, indium, zinc, and combinations thereof, such as $SnI_4$, $GaI_3$, $AlI_3$, $HfI_4$, $InI_3$, and $ZnI_2$. Of course, other second metal halides may be used, provided that they have a high vapor pressure relative to the vapor pressure of the first metal halide of the fill material. In some embodiments, the at least one second metal halide is chosen from $SnI_4$, $GaI_3$, $HfI_4$ and combinations thereof. In further non-limiting embodiments, the at least one volatile material is mercury free.

One function of the at least one volatile material is to increase voltage $V_r$ during early run-up, prior to reaching full light output, rather than contribute to the steady state photometric output of the lamp. In some embodiments, the phrase, "early run-up" refers to the first 15 seconds after runup. However, various considerations in the lamp design may suggest that a longer or shorter window is appropriately considered, "early runup."

In some embodiments, the at least one volatile material increases voltage $V_r$ during early run-up by greater than 0 to about 40 volts, relative to the voltage $V_i$ at ignition. For example, the increase in $V_r$ during early run-up attributable to the at least one volatile material may range from about 5 to about 40 volts, such as about 10 to about 30 volts, or even about 10 to about 20 volts, relative to the voltage $V_i$ at ignition. Of course, increases to $V_i$ attributable to the at least one volatile material falling above, below, or between any of the aforementioned endpoints are possible, and are envisioned by the present disclosure.

Because the lamps of the present disclosure are designed for steady state operation at a relatively low $V_r$, relatively high $I_r$ condition, the impact of the volatile material on steady state $V_s$ should be considered when selecting the type and amount of volatile material added to the discharge chamber. In some embodiments, the type and amount of volatile material added is sufficient to increase voltage $V_r$ during early run-up by a desired (nominal) amount, but with limited or minimal contribution to the voltage $V_s$ during steady state operation. This is contrary to conventional metal halide lamp design, wherein volatile materials are added not only to increase voltage $V_r$ during run-up, but also to significantly increase voltage $V_s$ during steady state operation, as previously explained.

One metric for evaluating the impact of a volatile material on steady state operation is ratio of steady state voltage $V_s$ to voltage at ignition $V_i$, i.e., $V_s/V_i$. In conventional lamps that utilize volatile materials to enhance voltage $V_r$ during run-up and voltage $V_s$ at steady state, the ratio $V_s/V_i$ is generally a high value, e.g., greater than 3.33 to about 5, or more. In contrast, the metal halide lamps of the present disclosure can exhibit a relatively low $V_s/V_i$, even when at least one volatile material is added to the discharge chamber. For example, the lamps of the present disclosure may exhibit a $V_s/V_i$ of less than about 3.33, such as less than about 2.5, or even less than about 2.

Because of the limited impact of the volatile material on $V_s$, the lamps of the present disclosure can be operated at a relatively low $V_s$, relatively high $I_s$ condition. This permits the use of electrodes that have a current rating that can support $I_s$ and in some cases, a current carrying capacity that permits greater $I_r$ than is allowed in conventional metal halide lamps.

The present disclosure also contemplates metal halide lamps having the general components previously described (i.e., discharge vessel, discharge space, etc.), wherein the lamp has a first voltage $V_i$ at ignition, and a nominal light output $L_n$, a power $P_{req}$, a second voltage $V_s$, and a current $I_s$ during steady state operation, wherein $V_s/V_i$ is less than or equal to about 3.33; and the electrode tip(s) is/are sized or otherwise configured such that $C_1$ is greater than or equal to $I_s$. In some embodiments, such lamps have a $V_s/V_i$ less than or equal to about 2.5, where $C_1$ is greater than or equal to $I_s$.

The metal halide lamps may also be configured to exhibit a relatively low steady state voltage $V_s$, regardless of whether a volatile material is added to the discharge chamber. For example, $V_s$ of the lamps described herein may range from greater than 0 to about 50 volts, such as from about 10 to about 50 volts, including from about 15 to about 40 volts, from about 15 to about 35 volts, and even from about 15 to about 30 volts. In these embodiments, the electrode assemblies (e.g., the electrode tips and/or feedthroughs) are appropriately sized or otherwise configured to exhibit a current rating sufficient to accommodate the elevated steady state currents $I_s$ that correlate to these low steady state voltages. And in some cases, the electrode assemblies have a current carrying capacity sufficient to allow run-up currents $I_r$ of up to 10 times $I_s$ or more, as previously described.

Another metric for evaluating the impact of the at least one volatile material on steady state voltage $V_s$ is the ratio of steady state voltage $V_{s2}$ to steady state voltage $V_{s1}$, wherein $V_{s1}$ corresponds to the steady state voltage $V_s$ of a lamp that does not contain at least one volatile material in addition to the fill material, and $V_{s2}$ corresponds to the steady state voltage $V_s$ of an otherwise identical lamp that contains at least one volatile material. In an ideal case, the lamps according to the present disclosure exhibit a $V_{s2}/V_{s1}$ ratio of 1 or about 1, although $V_{s2}/V_{s1}$ ratios greater than one are also permissible. In some embodiments, the lamps according to the present disclosure exhibit a $V_{s2}/V_{s1}$ ratio ranging from greater than about 1 to less than about 2.5, such as greater than about 1.1 to about 2.0, greater than about 1.2 to about 1.9, greater than 1.3 to about 1.7, or even greater than about 1.3 to about 1.6. In some embodiments, the $V_{s2}/V_{s1}$ ratio is less than or equal to about 1.5. As a non-limiting illustration of the $V_{s2}/V_{s1}$ concept, some lamps according to the present disclosure may exhibit a steady state lamp voltage $V_{s1}$ (i.e., without added volatile material) of about 20V. Upon addition of a volatile materials of the present disclosure, the steady state voltage of such lamps may rise by a factor of about 1.3 to about 2.0, i.e., to about 26V-40V.

The amount of at least one volatile material may vary widely, and may differ depending on the type of volatile material used and its interaction with other components in the discharge space, e.g., the fill material. For example, in cases where mercury is added as a volatile material to the discharge chamber of a metal halide lamp, the amount of mercury may range from greater than 0 to about 20 mg/cc, such as greater than 0 to about 15 mg/cc, from about 4 mg/cc to about 10 mg/cc, from about 2 mg/cc to about 8 mg/cc, from about 2 mg/cc to about 7 mg/cc, or even about 2 mg/cc to about 5 mg/cc. In some embodiments, the lamps of the present disclosure contain about 3 mg/cc of mercury as a volatile material in addition to the fill material. Of course, mercury additions above, below, and within each of the aforementioned endpoints are permissible, and are envisioned by the present disclosure.

In examples where at least one second metal halide is added as a volatile material to the discharge chamber of a metal halide lamp, the amount added may vary depending on the nature of the second metal halide(s) added. In some embodiments, the amount of each second metal halide may range from greater than 0 to about 20 mg/cc, such as greater than 0 to about 15 mg/cc, from about 2 mg/cc to about 11 mg/cc, from about 4 mg/cc to about 10 mg/cc, from about 5 mg/cc to about 10 mg/cc, or even about 6 mg/cc to about 10 mg/cc.

In some embodiments, the at least one second metal halide contains $SnI_4$ in an amount ranging from greater than 0 to about 15.5 mg/cc, such as about 2 to about 10 mg/cc, or even about 5 to about 10 mg/cc. In other non-limiting embodiments, the at least one second metal halide contains $GaI_3$ in an amount ranging from about greater than 0 to about 10 mg/cc, such as about 1.5 to about 10 mg/cc, about 2 to about 7 mg/cc, or even about 3 to about 5 mg/cc. And in further non-limiting embodiments, the at least one second metal halide contains $HfI_4$ in an amount ranging from greater than 0 to about 15.5 mg/cc, such as about 2 to about 10.5 mg/cc, about 2.5 to about 7.75 mg/cc, or even about 2.5 to about 5 mg/cc. Of course, second metal halide amounts above, below, and within the aforementioned endpoints are permissible, and are envisioned by the present disclosure.

The weight % ratio of volatile material to the fill material may vary widely. For example, the weight ratio of volatile material to non-volatile material may be 0, from greater than 0 to about 0.5, from greater than 0 to about 0.4, and from 0.1 to about 0.3. In some embodiments, the weight % ratio of volatile material to the fill material ranges from about 0.2 to about 0.25.

The lamps according to the present disclosure may also exhibit improved light output during early run-up (e.g., the first 15 seconds of run-up), relative to the light output of a traditional metal halide lamp. In some embodiments, the lamps described herein exhibit a relative light output greater than about 0.4, such as greater than about 0.5, 0.6, 0.7, or even 0.8 during early run-up.

The lamps according to the present disclosure may also exhibit improved efficacy at ignition. For example, the lamps described herein may exhibit efficacy at ignition ranging from greater than about 10 to about 60%, such as about 30 to about 60%, or even about 40 to about 60%. In some embodiments, the efficacy at ignition ranges from about 40 to about 50% or more.

The lamps described herein may also exhibit improved run-up time, relative to conventional metal halide lamps. For example, the lamps of the present disclosure may exhibit run-up times less than or equal to about 20 seconds, such as less than or equal to about 15 seconds, less than or equal to about 10 seconds, less than or equal to about 7 seconds, or even less than or equal to about 5 seconds.

Another aspect of the present disclosure relates to methods of operating a metal halide lamp. The methods include providing a metal halide lamp constructed as described above. The metal halide lamp has a first voltage $V_i$ during ignition, and a nominal light output $L_n$, a power $P_{req}$, a second voltage $V_s$, and a current $I_s$ during steady state operation. The methods also include the steps of igniting the metal halide lamp, running up the metal halide lamp to steady state operation and $L_n$; and maintaining the metal halide lamp at $L_n$ during steady state operation by applying $P_{req}$, where $P_{req}=V_s*I_s$.

In some embodiments of the methods described herein, the $V_s/V_i$ ratio is within the range of values previously described. For example, $V_s/V_i$ may be ≤about 3.33, such as ≤about 2.75, or even ≤2. In some cases, $V_s/V_i$ is within the aforementioned ranges, even when $V_s$ is, for example, less than about 60V, 50V, 40V, 30V, or even 20V.

The electrode assemblies may be of a conventional or hybrid configuration, as previously described. In either case, the electrode assemblies include an electrode tip having a current rating $C_1$ and a feedthrough having a current rating $C_2$. In some embodiments of the methods described herein, the electrode assemblies are sized or otherwise configured such at least one of $C_1$ and $C_2$ are greater than $I_s$, even when one or both of $V_s$ and $V_s/V_i$ are maintained in the aforementioned ranges.

In further non-limiting embodiments, the electrode assemblies may be configured such that at least one of the electrode tip and feedthrough have a current carrying capacity ranging from about 1 to about 10 times $I_s$, such as about 1 to about 7.5 times, $I_s$, or even from about 1 to about 5 times $I_s$, even when $V_s/V_i$ is maintained within the aforementioned range(s). In some embodiments, the electrode assemblies can withstand run-up currents ranging from about 2 to about 5 times $I_s$, such as about 3 to about 4 times $I_s$.

In some embodiments, the methods described herein further include applying a run-up current $I_r$ to the metal halide lamp, where the ratio of run-up current to steady state current is ≤about 10, such as about 3 to about 5.

In further non-limiting embodiments, the methods described herein may utilize metal halide lamps that include at least one volatile material, as previously described. In some cases, the volatile material is added in amounts that do not substantially impact $V_s$, as previously described.

Other than in the examples, or where otherwise indicated, all numbers expressing endpoints of ranges, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present disclosure. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the present disclosure are approximations, unless otherwise indicated the numerical values set forth in the specific examples are reported as precisely as possible. Any numerical value, however, inherently contains certain errors necessarily resulting from the standard deviation found in their respective testing measurements.

EXAMPLES

35 W Mercury-Free and Low Dose Mercury-Containing Metal Halide Lamps

A typical 35 W Hg containing lamp has a steady state voltage about 85V, thus requiring an electrode appropriately sized for 0.4 A operation. Testing revealed that reasonable run-up currents of about 1.5 A were possible for such lamps, with electrode melting observed at about 2 A.

To investigate the impact of low mercury dose on the electrical characteristics of a 35 W lamp, Hg free lamps were constructed from 35 W experimental Powerball (Osram-Sylvania) arc tubes containing 2.4 mg of a metal halide salt blend containing NaI, $DyI_3$, $TmI_3$, $HoI_3$, $TlI_3$, and $CaI_2$ in a weight ratio of 51.0:8.34:8.33:8.33:10.0:14.0 as a fill material and 10-14 bar of xenon as a fill gas. A hybrid electrode composed of a 70 W (WUW) tip welded to a 35 W feedthrough was used. Because the 70 W electrode tip was conventionally used in a 70 W lamp with a $V_s$ of 90V, it had a current rating C of about 0.78 A (C=70 W/90V). Similar 35 W lamps containing 2.4 mg of the metal halide salt blend as a fill material, 6 bar xenon as a fill gas, and 2.5 mg of mercury were constructed.

The electrical properties and performance of these lamps was measured using a constant current to full light output method, in which the instantaneous efficacy of the lamp was estimated in order to calculate the required instantaneous power for maintaining steady light output during warm-up. A more detailed description of this method is found in U.S. Pat. No. 7,589,477, which is incorporated herein by reference. The instantaneous efficacy was estimated as a function of the energy deposited to the lamp since ignition. During early run-up when the demanded power is very high, the lamps were run at the maximum allowed run-up current until full light output is attained. Data was acquired from unjacketed lamps operated vertically in a bell jar under vacuum. The results are reported in FIGS. 3A-3D.

Figure 3A:
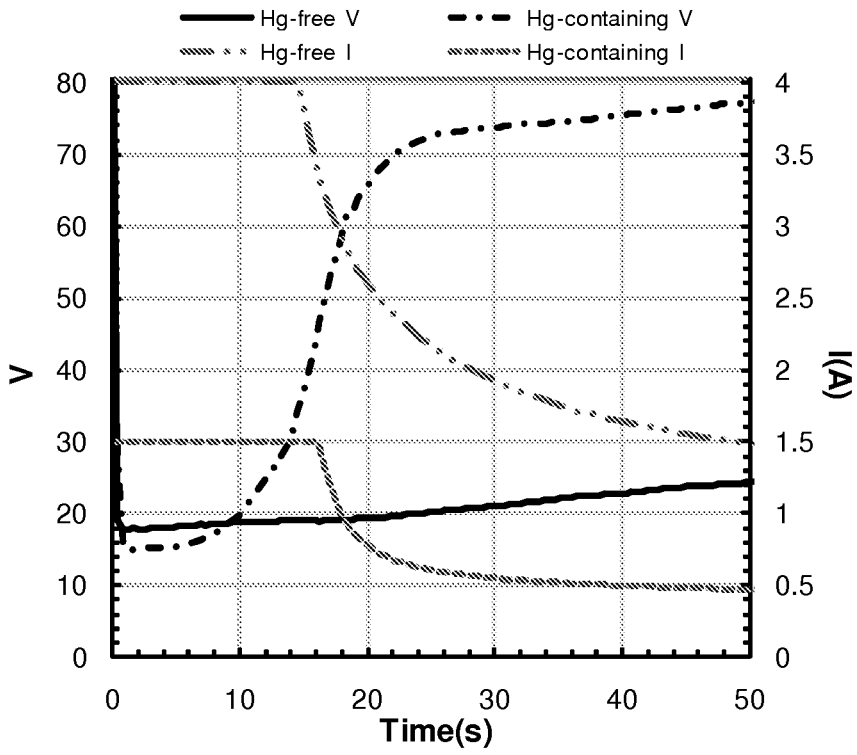
FIG. 3A is a plot of voltage and current vs. time during run-up of a mercury-containing metal halide lamp and a mercury-free metal halide lamp according to the present disclosure.
Figure 3B:
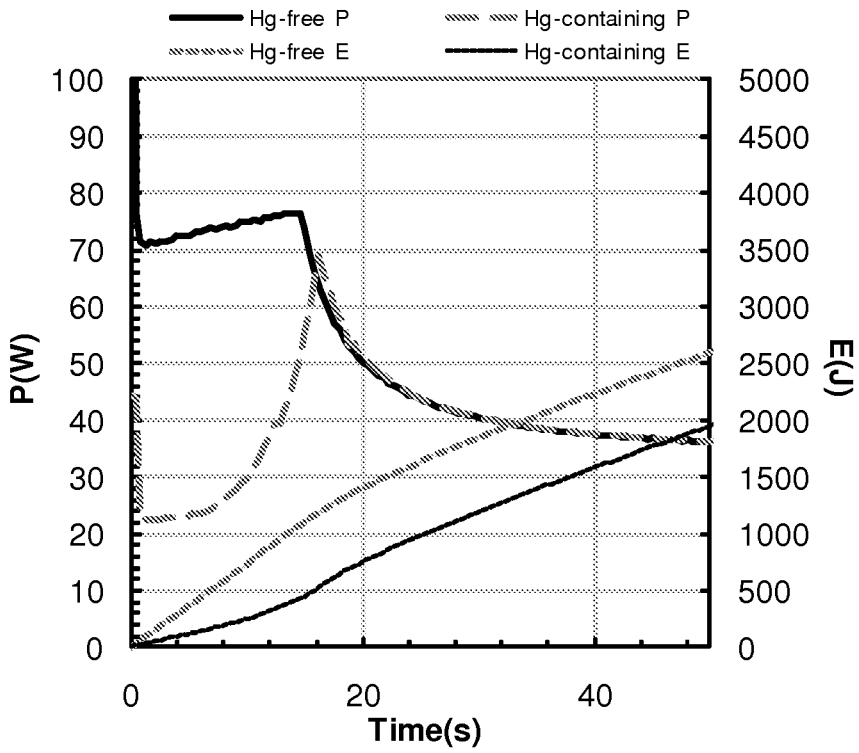
FIG. 3B is a plot of arc power P(W) and deposited energy (J) vs. time during run-up of a mercury-containing metal halide lamp and a mercury-free metal halide lamp according to the present disclosure.
Figure 4:
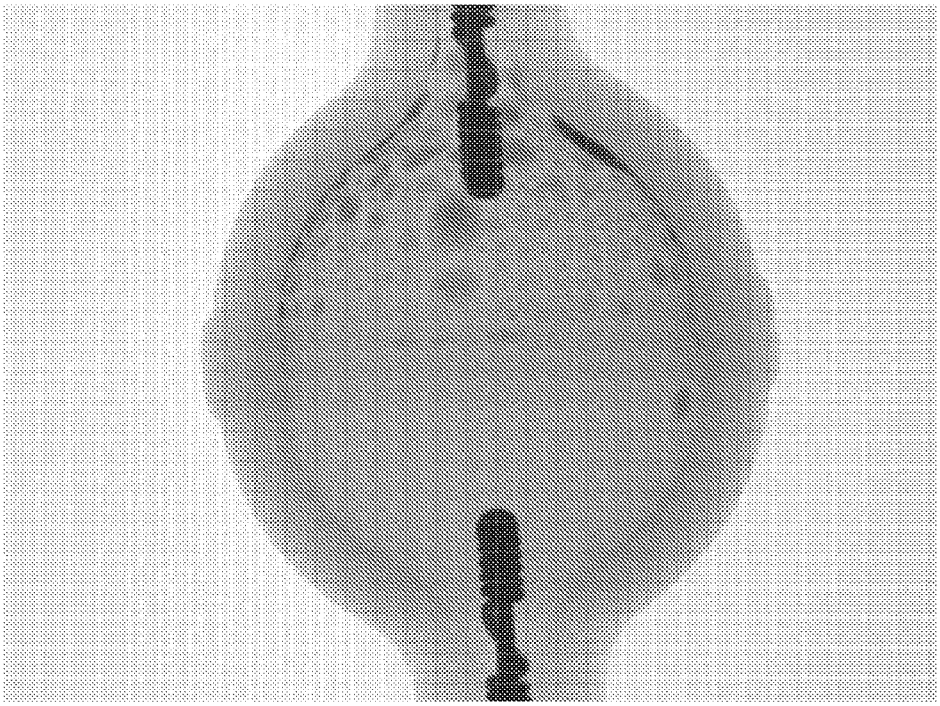
FIG. 4 is an x-ray image of a mercury free metal halide lamp including electrodes according to the present disclosure.

FIG. 3A plots the run-up voltage and run-up current vs. time for the tested 35 W Hg-containing and Hg-free lamps. As shown, the initial voltages of the Hg-containing and the Hg-free lamps were similar, but higher run-up current was allowed in the Hg-free lamps. The maximum allowed run-up currents were about 1.5 A for the Hg-containing lamps, and about 4 A for the Hg-free lamps. The Hg-free lamps (without a volatile material to compensate for the absence of Hg) resulted in a steady state voltage $V_s$ of about 25V, as compared to the steady state voltage $V_s$ of 85V observed in the conventional mercury containing lamp. An X-ray image (FIG. 4) of the Hg-free lamp after 4 A run-up was taken, and showed some electrode rounding due to melting. As shown in FIG. 3B, the Hg-free lamps exhibited increased run-up power and faster energy deposition, relative to the Hg-containing lamps.

Figure 3C:
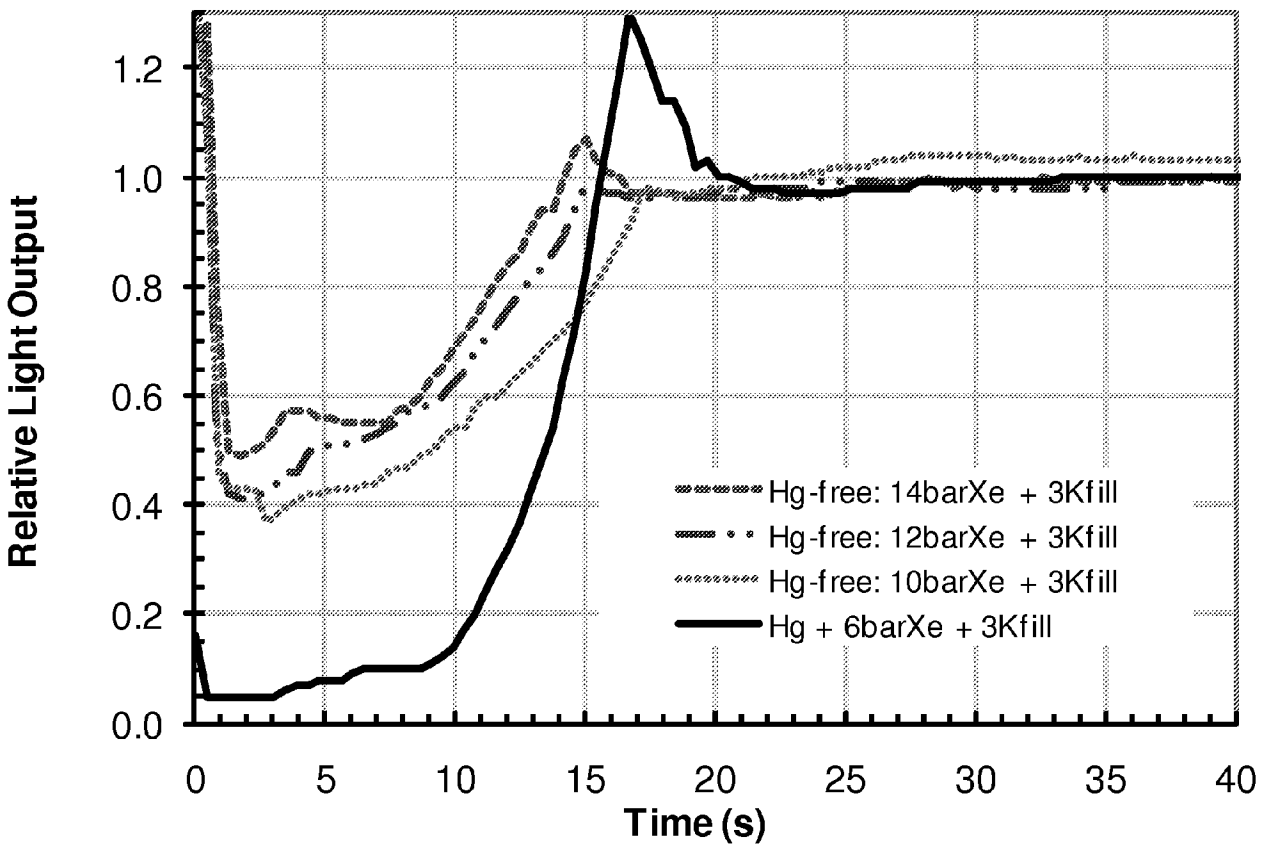
FIG. 3C is a plot of relative light output vs. time for a mercury-containing metal halide lamp and a mercury-free metal halide lamp according to the present disclosure.

FIG. 3C is a plot of relative light output vs. time measured from the Hg-containing and Hg-free lamps. As shown, the run-up time (time to relative light output equals 1) was similar for both types of lamps. The higher run-up power of the Hg-free lamps resulted in a higher initial light output relative to the Hg-containing lamps. Indeed, the initial light output of the Hg-free lamps was about 40-50%, which is competitive with compact fluorescent lamps. In contrast, the Hg-containing lamps exhibited an initial light output of about 5%.

Figure 3D:
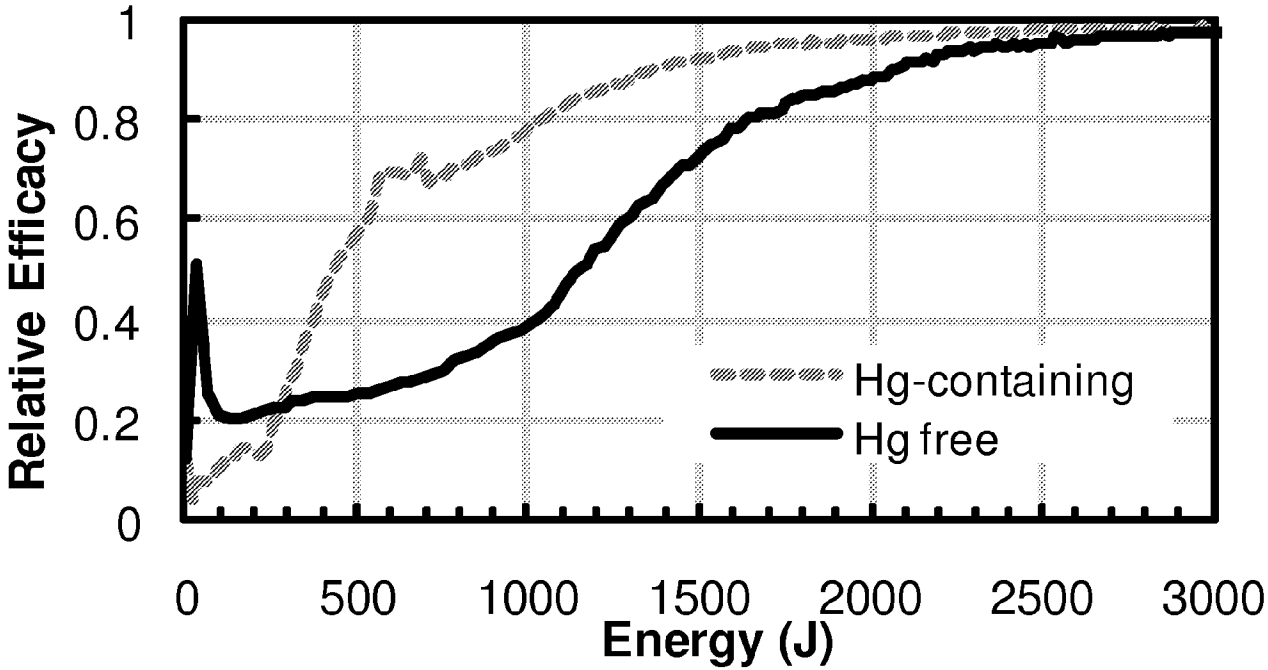
FIG. 3D is a plot of relative efficacy vs. energy (J) deposited during run-up for a mercury-containing metal halide lamp and a mercury-free metal halide lamp according to the present disclosure.

It was expected that the Hg-free lamps would exhibit shorter run-up time due to the higher run-up power that could be applied. However, the data revealed that the relative efficacy of the Hg-free lamps increased more slowly than the Hg-containing lamps, as shown in FIG. 3D. This data suggested that in the absence of Hg, the lamp should be heated to higher temperature (and thus requires more energy delivered to the lamp) in order to evaporate appreciable light emitting species from the fill material.

20 W Mercury-Free and Low Dose Mercury-Containing Metal Halide Lamps

To investigate the impact of mercury dose in low wattage lamps, 20 W metal halide lamps were constructed using standard Powerball 20 W arc tubes (Osram-Sylvania). Because the seal temperatures of the standard 20 W arc tubes was considered low, additional lamps were manufactured with capillaries that were shortened by 2.5 mm. The capillary shortening increased seal temperature, and was expected to shorten run-up time.

To allow experimentation at high run-up currents, oversized electrode assemblies were used. These electrode assemblies, normally used in 35 W lamps, had feedthrough diameter compatible with the 20 W Powerball arc tube. Because the electrode assemblies were normally used in a 35 W product with a $V_s$ of 90V, they had a current rating C of about 0.39 A (C=35 W/90V). The electrodes were spaced for a 3.4 mm arc gap, and were appropriately sealed. Based on previous experience with this type of electrode, it was expected that run-up currents as high as 1.5 A could be safely used without appreciable melting. This was confirmed by x-ray imaging one of the 20 W lamps after run-up operation at 1.5 A, which showed intact electrodes without evidence of significant melting.

The lamps were filled with high pressure xenon, various amounts of mercury, and varying amounts of metal halide salt (NaI, $DyI_3$, $TmI_3$, $HoI_3$, $TlI_3$, and $CaI_2$ in a weight ratio of 51.0:8.34:8.33:8.33:10.0:14.0), as summarized in Table 1 below.

TABLE 1

20 W Hg-free and Hg-containing lamp construction

| Lamp | Arc tube | Electrode | Hg dose (mg) | Xe (bar) | Metal Halide Salt (mg) |
|---|---|---|---|---|---|
| 1 | 20 W - standard capillaries | 35 W WUW | 2.0 | 6 | 2.5 |
| 2 | 20 W, capillaries reduced 2.5 mm | 35 W WUW | 2.0 | 6 | 2.0 |
| 3 | 20 W capillaries reduced 2.5 mm | 35 W WUW | 1.5 | 6 | 2.0 |
| 4 | 20 W, capillaries reduced 2.5 mm | 35 W WUW | 1.0 | 6 | 2.0 |
| 5 | 20 W, capillaries reduced 2.5 mm | 35 W WUW | 0.2 | 6 | 2.0 |
| 6 | 20 W, capillaries reduced 2.5 mm | 35 W WUW | 0.0 | 6 | 2.0 |

The unjacketed lamps were run-up vertically in a bell jar using a constant current until full light output method. Once full light output was reached, power was gradually reduced in order to maintain rated light output for each lamp.

Figure 5:
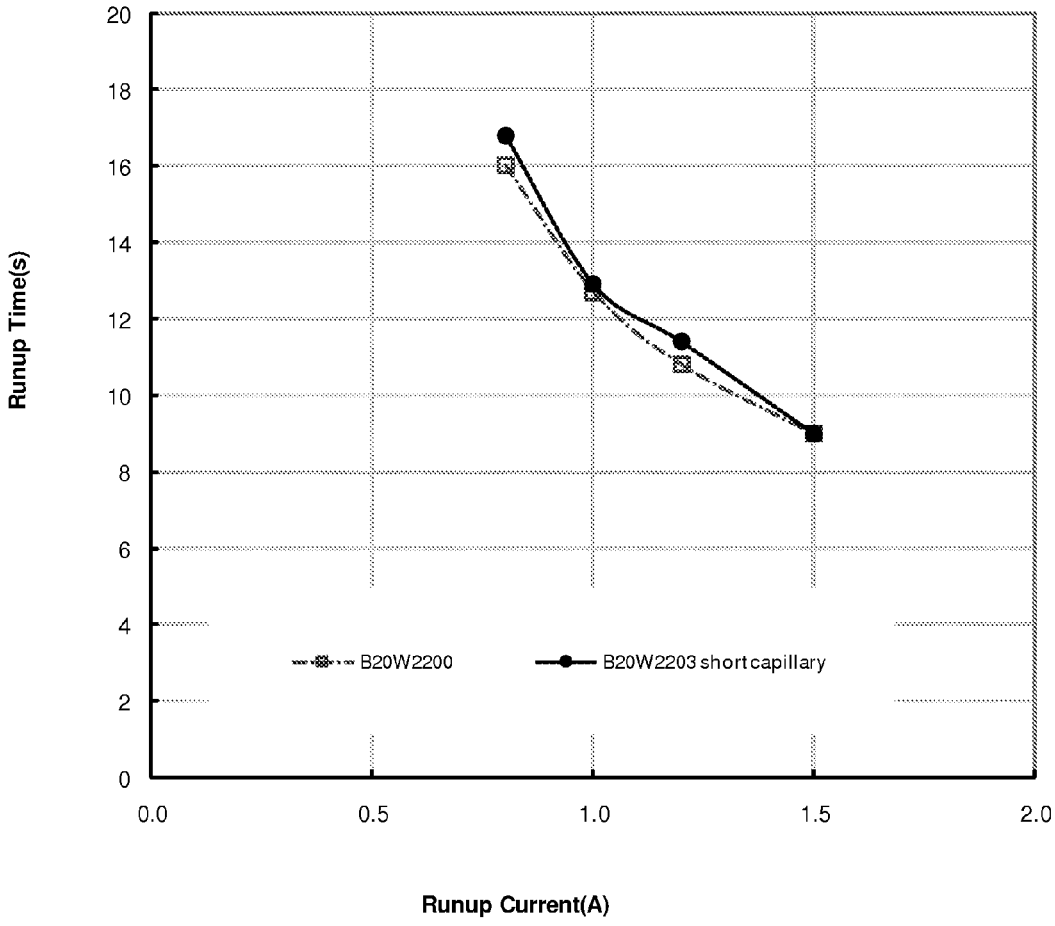
FIG. 5 is a plot of run-up time vs. run-up current for two mercury-containing metal halide lamps according to the present disclosure.

FIG. 5 plots run-up time vs. run-up current for Lamps 1 and 2. As shown, the run-up time of lamp 2 (short capillary) was not reduced compared to lamp 1. Although the mass of the short capillary lamp was decreased, the estimated reduction in heat capacity for that lamp was modest (<15%) and may have been offset by increased thermal conductivity losses.

Figure 6:
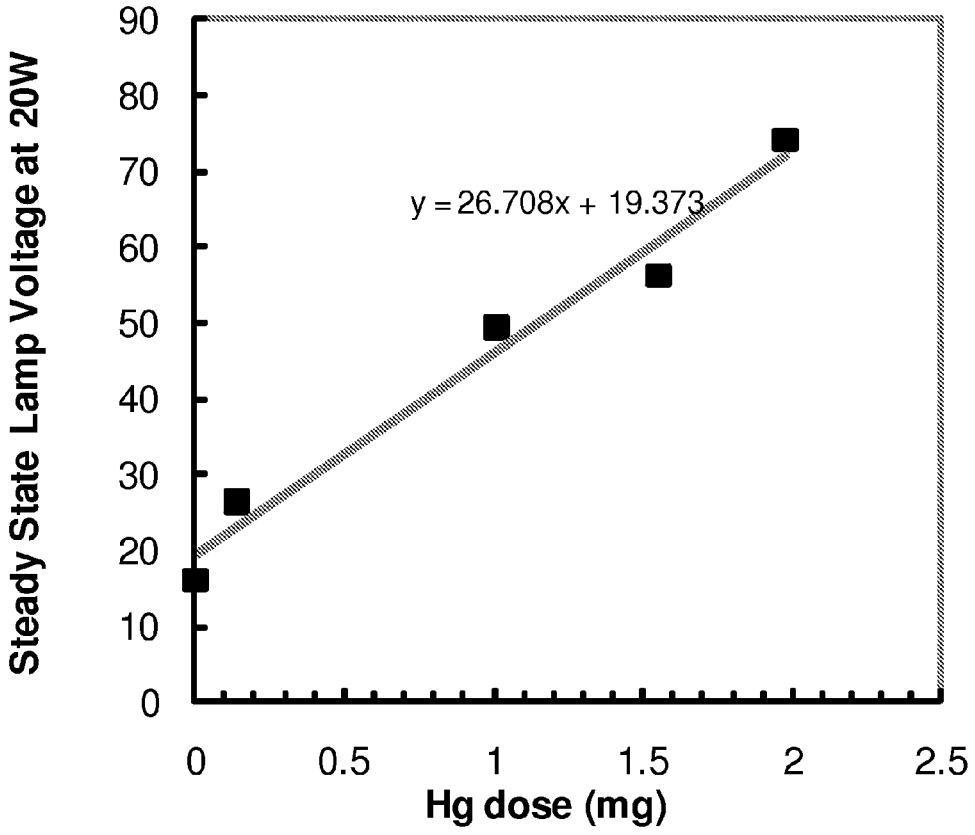
FIG. 6 is a plot of steady state lamp voltage at 20 W vs. Hg dose (mg) for mercury-free and mercury-containing metal halide lamps according to the present disclosure.

The steady state lamp voltage for lamps 1-6 was evaluated, and is plotted vs. Hg-dose in FIG. 6. As shown, even the lamps with the largest Hg dose (2.0 mg) exhibited a steady state voltage of about 70V, which is less than the 95V steady state voltage seen in a standard 20 W production metal halide lamp.

Figure 7:
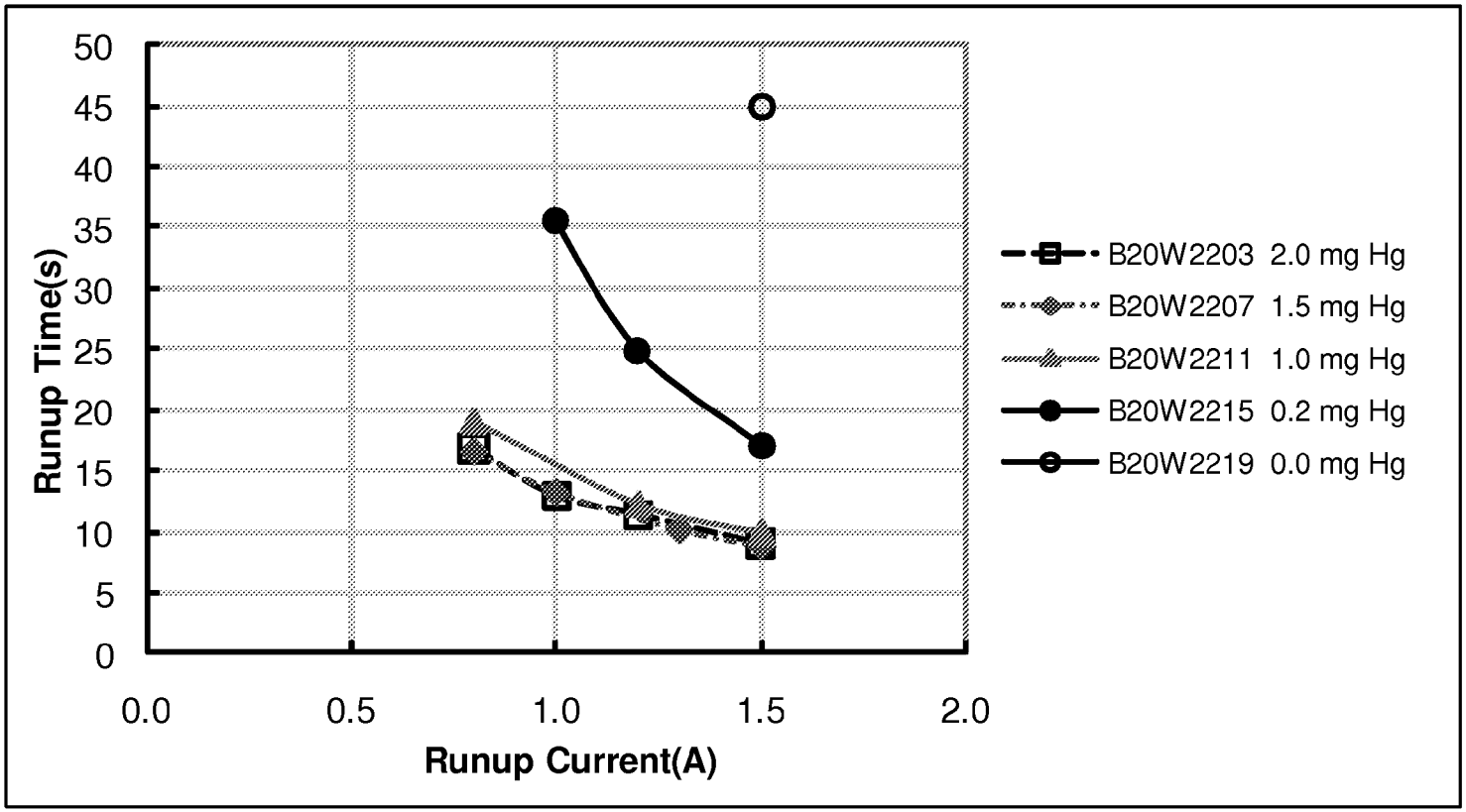
FIG. 7 is a plot of run-up time vs. run-up current for mercury-free and mercury-containing metal halide lamps in accordance with the present disclosure.
Figure 8:
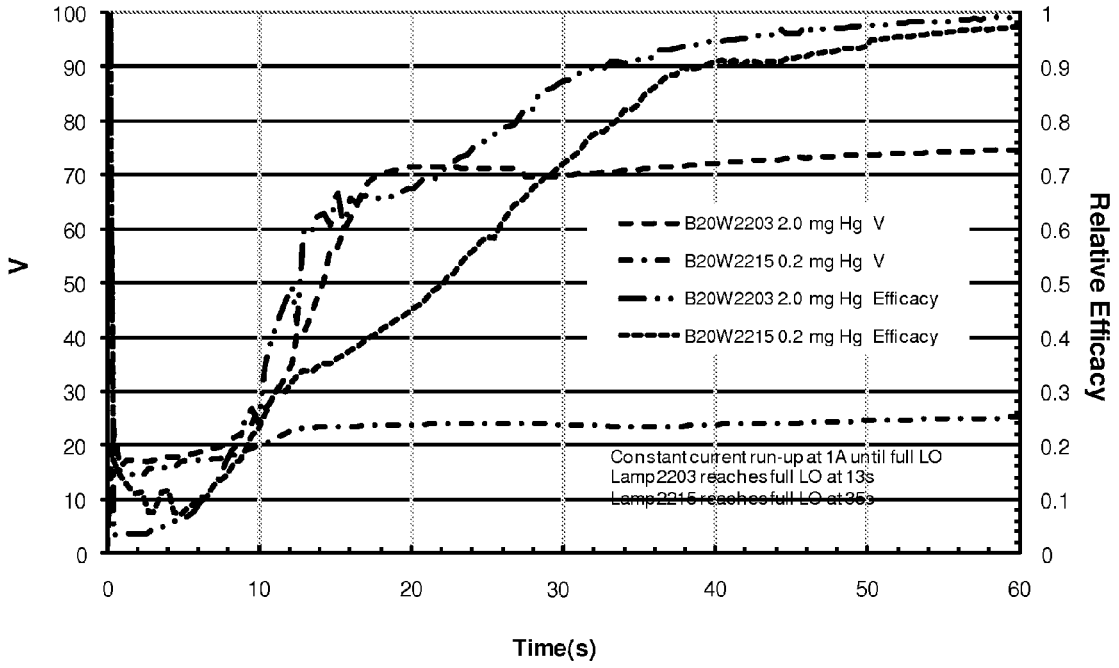
FIG. 8 is a plot of lamp voltage and efficacy vs. time for several mercury-containing metal halide lamps in accordance with the present disclosure.

FIG. 7 plots run-up time vs. allowed run-up current, for lamps with various Hg doses. As shown, the run-up time was not affected much until the Hg dose was quite low, e.g., 0.2 mg. At this low Hg dose, the initial voltage rise due to Hg evaporation during run-up was reduced, resulting in a corresponding reduction in the amount of energy that could be deposited to the lamp during a constant current run-up. Also, the rise towards full efficacy was delayed at very low Hg dose. This is demonstrated in FIG. 8, which plots voltage and relative efficacy vs. time observed during run-up of lamps 2 (2.0 mg Hg) and 5 (0.2 mg Hg).

For a given allowed run-up current, it was observed that run-up time increases as the Hg dose decreased. However, lower Hg dose resulted in lower steady state lamp voltages and higher steady state currents. This suggested that even larger electrodes in such lamps would permit the use of even higher tolerable run-up currents, as was confirmed in the testing of the larger wattage lamps described above.

This was further confirmed by measuring the steady state voltage (and hence, steady state current) of the 20 W lamps described above, determining an appropriate run-up current (3-4 times steady state current), and measuring run-up time at the determined run-up current. During such testing, lamp 2 (2.0 mg Hg) exhibited a steady state voltage of about 75V, and a steady state current of about 0.27 A. This suggested an allowed run-up current of about 3.5-4 times the steady state current, or about 1 A. When run-up under this current condition, lamp 2 exhibited a run-up time of about 13 seconds. Lamp 4 (1.5 mg Hg) exhibited a steady state voltage of 57V, and a steady state current of 0.35 A, suggesting allowed run-up currents as high as 1.3 A. When run-up under this current condition, lamp 4 exhibited a run-up time of about 10 s.

Reducing Hg even further was expected to further reduce steady state voltage and increase steady state, thereby permitting even higher run-up currents. This was observed in lamps 5 (1 mg Hg), which exhibited steady state voltage of 48V and steady state current of 0.41 A. This steady state operation corresponded nicely to the design current for the 35 W electrode assembly used in the test lamps, and suggested a run-up current as high as 1.5 A. When run-up under this current condition, lamp 4 exhibited a run-up time of about 10 s, the same as lamp 4.

Lamp 6 (0.2 mg Hg) exhibited steady state voltage of 25V and steady state current of 0.8 A. This suggested that a run-up current as high as 3 A might be used. Unfortunately, this run-up current exceeded the upper current limit for the 35 W electrode assemblies used in these test lamps, so run-up time under the suggested current condition could not be measured using lamp 6. However, it was expected that appropriately sized (larger) electrodes would support the increased run-up current, thereby further reducing run-up time at the 0.2 mg Hg dose. Lamps with similar Hg dose and larger electrodes were constructed and tested in connection with the evaluation of volatile materials other than Hg. Testing of these lamps is discussed below.

As noted above, it was observed that low voltage lamps can have faster run-up. These lamps had low steady state voltage, which corresponded to high steady state currents. This suggested the use of higher run-up currents, which in turn suggested the use of electrode assemblies that were appropriately sized or otherwise designed to tolerate such higher run-up currents. It was found that small doses of Hg resulted in faster run-up, relative to Hg-free lamps. From this data, it appeared that an ideal Hg dose was just enough to provide voltage during early run-up, but small enough that the dose was fully evaporated by the time full light output is reached, thereby minimizing its impact on steady state voltage.

Mercury-Free and Low Dose Mercury-Containing Metal Halide Lamps with 70 W Electrode Tips To further investigate the impact of Hg dose and electrode size on run-up characteristics, additional 20 W lamps were constructed. These lamps were substantially identical in structure as the 20 W Hg-free and Hg-containing lamps described above, except that 70 W electrode tips were used. Such electrode tips were larger than the previously tested 35 W tips and, due to their higher current rating, were expected to permit the use of even higher run-up currents.

More specifically, the lamps were made from 20 W arc tubes made by Osram Sylvania. A hybrid electrode was formed by welding a 70 W non-WUW electrode tip to a 35 W feedthrough. Because the electrode tips were conventionally used in a 70 W product with a $V_s$ of 90V, they had a current rating C of about 0.78 A (C=P/V). The targeted electrode gap was 3 mm, and the average gap was 2.8 mm. As with the previous batch of 20 W lamps, the lamps were filled with high pressure xenon, various amounts of mercury, and varying amounts of metal halide salt, as summarized in Table 2 below.

TABLE 2

20 W Hg-free and Hg-containing lamp construction

| Lamp | Arc tube | Electrode | Hg dose (mg) | Xe (bar) | Metal Halide Salt (mg) |
|---|---|---|---|---|---|
| 7 | 20 W | 70 W Non-WUW | 2.0 | 6 | 2.5 |
| 8 | 20 W | 70 W Non-WUW | 1.5 | 6 | 2.5 |
| 9 | 20 W | 70 W Non-WUW | 1.0 | 6 | 2.5 |
| 10 | 20 W | 70 W Non-WUW | 0.5 | 6 | 2.5 |
| 11 | 20 W | 70 W Non-WUW | 0.2 | 6 | 2.5 |
| 12 | 20 W | 70 W Non-WUW | 0.0 | 6 | 2.5 |

Figure 9:
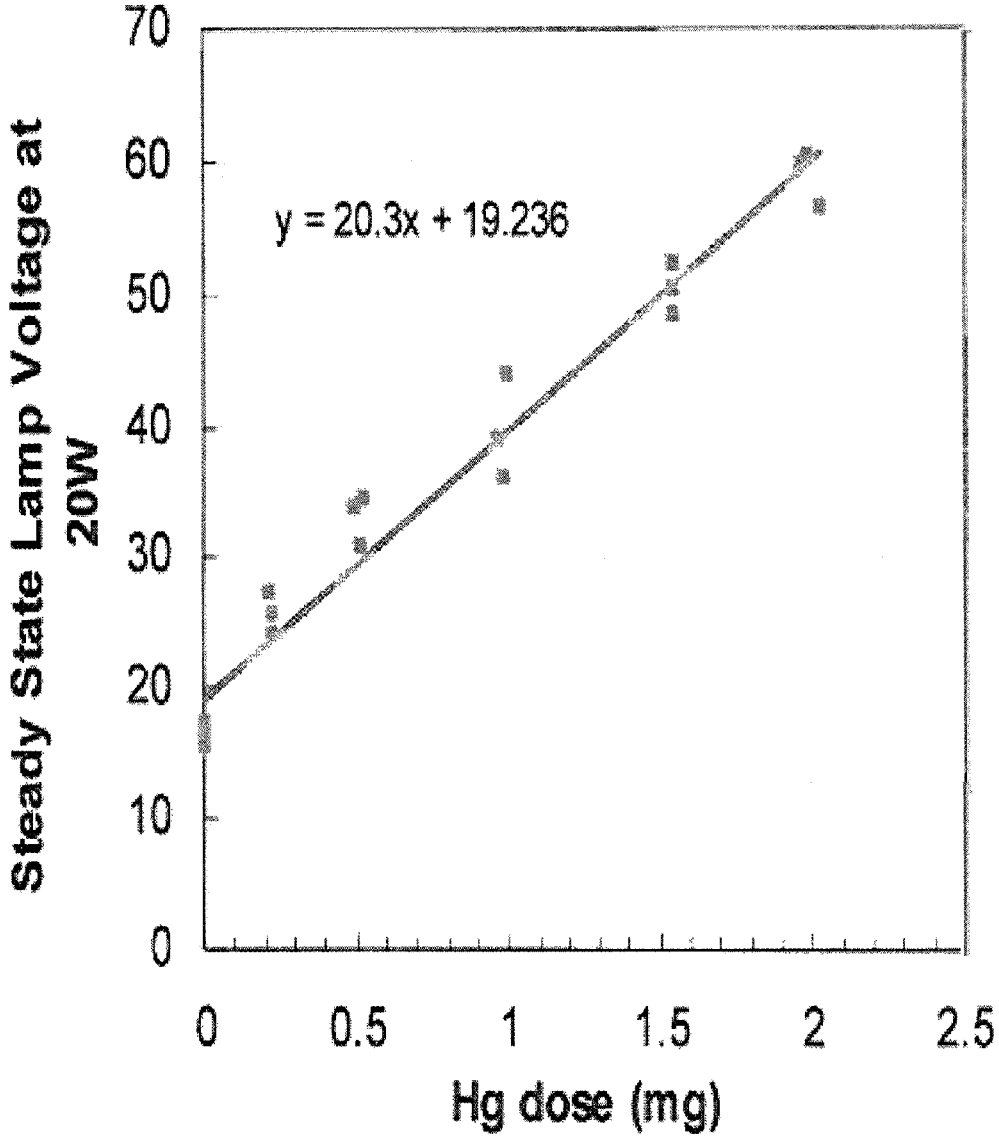
FIG. 9 is a plot of steady state lamp voltage vs. Hg dose for several mercury containing lamps according to the present disclosure.

The burners were operated in a bell jar under vacuum. The lamp voltage dependence on Hg dose was recorded, and is plotted in FIG. 9. No lamps with excessive voltages were found.

The lamps were run-up at constant current until full light output (lumen level equivalent to the lumen level at steady state operation) was reached. When full light output was reached, the lamps were not yet completely warm. The lower efficacy of the partially warm lamp was compensated for by higher than nominal power. As the lamp warmed further, the power was gradually decreased towards the nominal value, such that the lumen level remained relatively constant.

During run-up, the power required to maintain a constant lumen level was determined by estimating the instantaneous lamp efficacy as a function of total energy delivered to a cold lamp since ignition. Previously, the efficacy vs. energy relationship was described as an exponential approach to unity. In the present group of lamps, however, the efficacy vs. energy description was modified.

Because of the reduced Hg doses, the observed efficacy vs. energy behavior exhibited during a leveling off, or plateau, during run-up, likely indicating the complete evaporation of the Hg dose. The plateau was generally accompanied by a change in the rate of voltage rise. In addition, more energy was required to reach the plateau at higher Hg doses.

Figure 10:
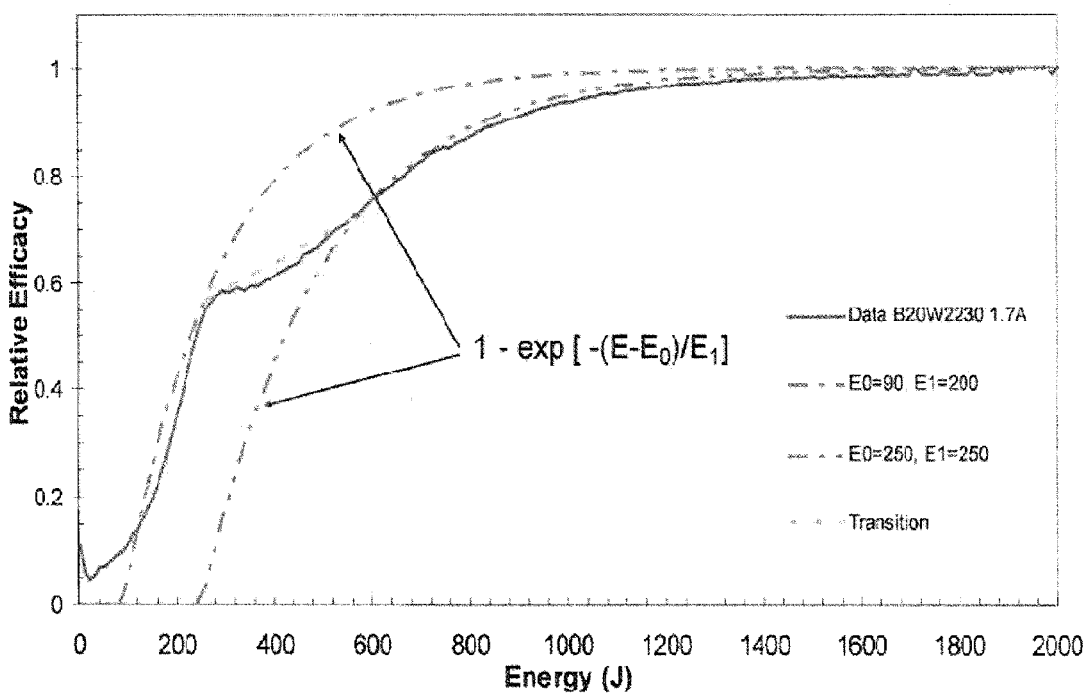
FIG. 10 is a plot of relative efficacy vs. deposited energy before and after the complete evaporation of an Hg dose for a mercury containing lamp according to the present disclosure.

In the present set of lamps, the efficacy vs. energy relationship was approximated by two curves plotting relative efficacy vs. energy before and after the complete evaporation of the Hg dose. This principle is exemplified in FIG. 10 which shows the two curves as connected with a linear transition region measured during run-up of lamp 9. The parameters $E_o$, $E_1$ of the two curves, as well as the energy range over which the transition takes place, were used to specify the efficacy vs. energy function for controlling run-up.

Figure 11:
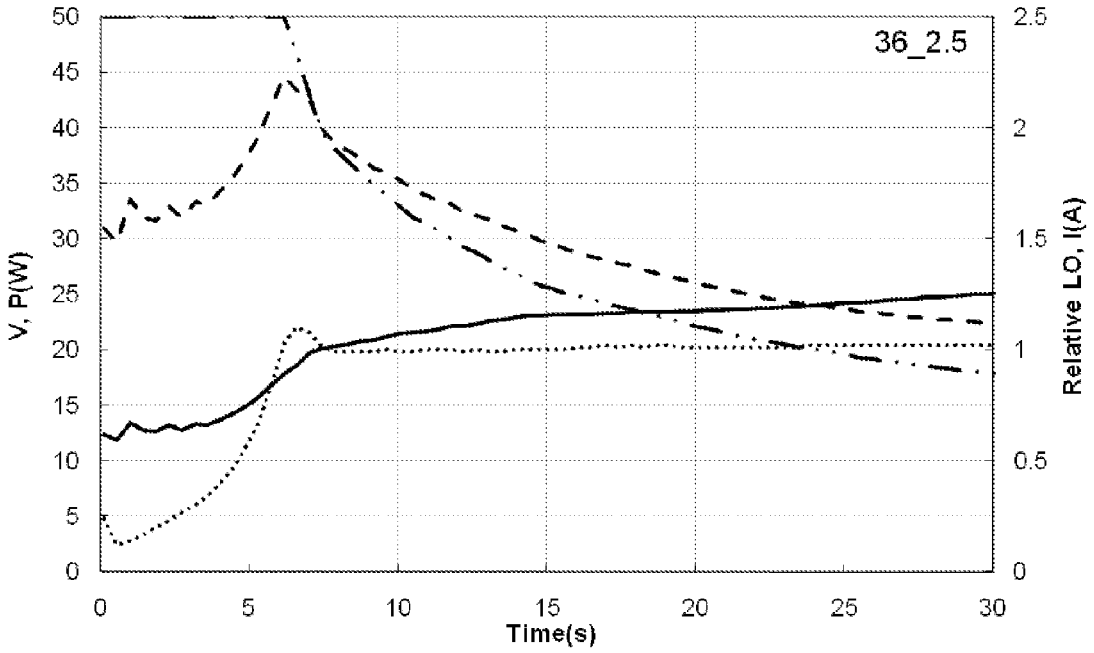
FIG. 11 is a plot of lamp voltage and relative light output vs. time during the run-up of exemplary lamps according to the present disclosure.

An exemplary run-up is shown in FIG. 11. In such run-up, the parameters were intentionally chosen to give a slight overshoot of the light output in order to facilitate determination of the run-up time. A direct approach of the light output towards unity indicates the minimum time to full light output for a given run-up current.

Figure 12:
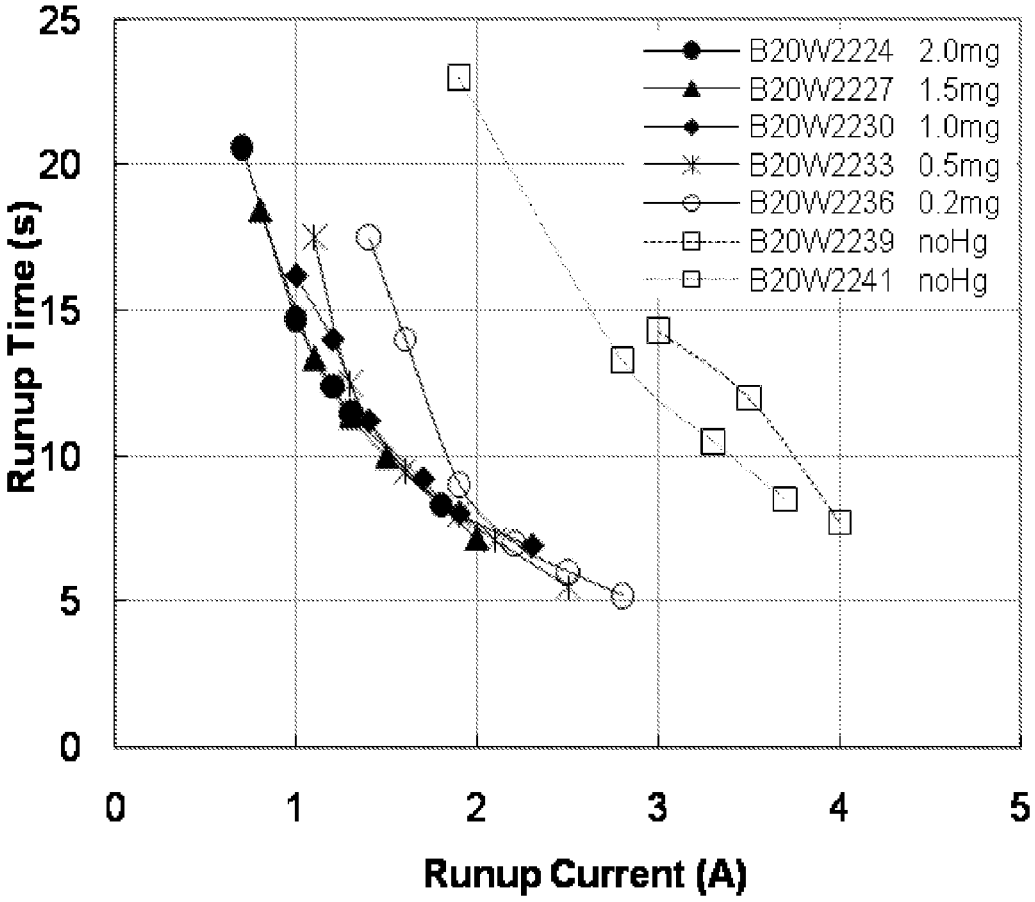
FIG. 12 is plot of run-up time vs. run-up current for several lamps in accordance with the present disclosure.
Figure 13:
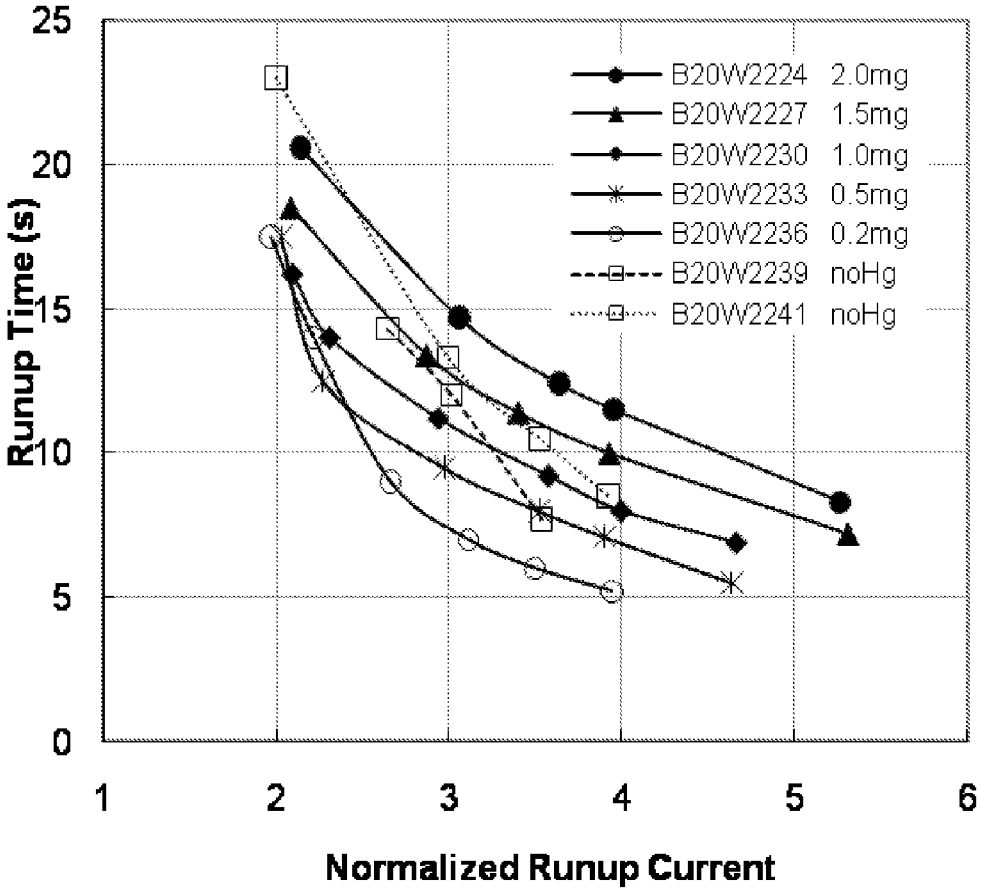
FIG. 13 is a plot of run-up time vs normalized run-up current for several lamps in accordance with the present disclosure.

FIG. 12 plots the run-up time to full light output vs. run-up current for lamps 7-12, and FIG. 13 plots run-up time for such lamps vs. normalized current. Consistent with prior tests, at low run-up currents, run-up time was longer for lamps with lower Hg dose. This can be attributed to (1) lower lamp voltages during run-up, which results in lower energy delivered to the lamp by a fixed run-up current; and (2) reduced Hg emission, which requires the lamp to be heated to higher temperatures in order to obtain metal halide emission for producing light.

From the data and x-ray analysis of the lamps, it was observed that run-up currents of 3-4 times the steady state design current of the electrode were reasonable. In the current series of lamps, melting and rounding of the entire electrode tip was observed at about a 3.5-4 amp run-up.

From the plot of run-up time vs. normalized run-up current in FIG. 13, it was observed that the optimal Hg dose for minimizing time to full light output was a small, non-zero dose of Hg that is large enough to contribute to light output and voltage during early run-up, but small enough so as to minimally contribute to steady state voltage. As shown, Lamp 11 exhibited a run-up time of about 5 to 7 seconds at 2.8 A and 2.2 A run-up, respectively.

Figure 14:
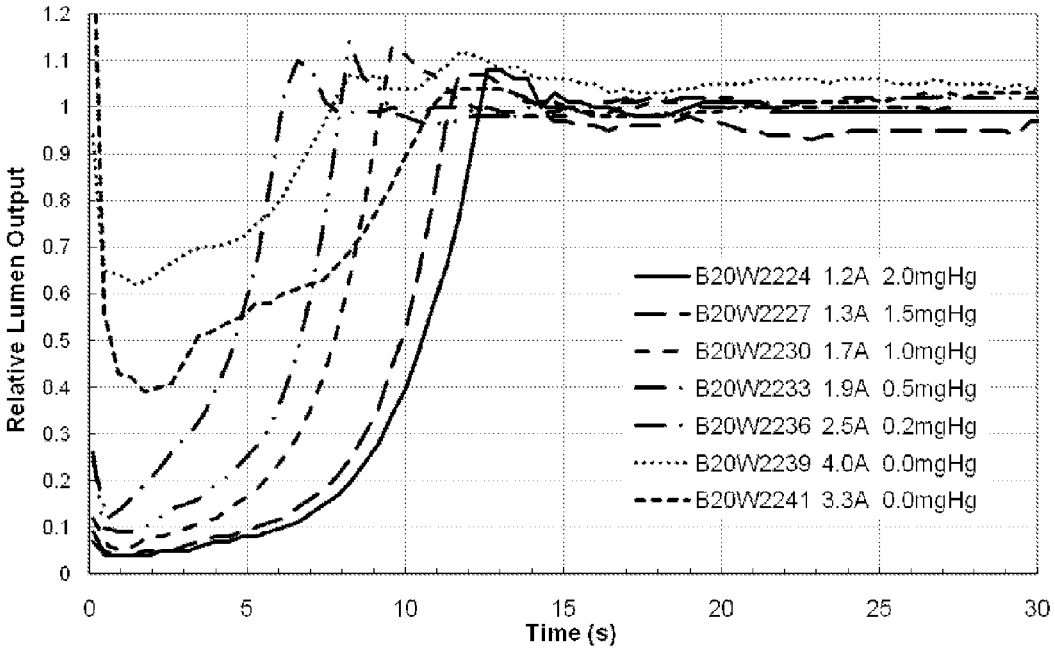
FIG. 14 is a plot of relative lumen output vs. time for lamps containing varying amounts of mercury in accordance with the present disclosure.

FIG. 14 plots light output vs. time for lamps 7-12 run-up at about 3.5 times the steady state current. As shown, the Hg free lamps were not the fastest to full light output, but exhibited considerably higher (0.4 to 0.6) initial light output level, relative to the Hg containing lamps. The run-up times for such lamps ranged from about 8 to about 13 s at normalized run-up currents of 3-4.

20 W Lamps with Hybrid Electrodes Containing 1 Mg Doses of Various Volatile Metal Halides As a continuance of the Hg testing described above, investigation was made into the use of small doses of volatile metal halides as a run-up accelerant in place of Hg. Various metal iodides were selected based on published data indicating relatively high vapor pressure, with some iodides having vapor pressure comparable to Hg. The intended purpose of the volatile metal halide addition was to increase voltage during early run-up, while avoiding or minimizing the contribution of the volatile metal halide to the steady state voltage and steady state photometric output of the lamp. Thus, it was expected that the tested lamps could provide an Hg-free option for reducing run-up time (even compared to the tested low dose Hg-containing lamps), To conduct these tests, experimental 20 W lamps were constructed using 20 W arc tubes combined with hybrid electrode assemblies having an increased current rating and carrying capacity. The hybrid electrode assemblies were formed by welding a 35 W feedthrough to a 70 w coil (non WUW) tip. Because the electrode tips were conventionally used in a 70 W product with a $V_s$ of 90V, they had a current rating C of about 0.78 A (C=P/V). The electrodes were spaced with a targeted arc gap of 3 mm, and appropriately sealed.

In one group of test lamps, the lamps were filled with 6 bar Xenon and a small dose of volatile metal compound. The target compositions are listed in Table 3 below.

TABLE 3

Target compositions for 20 W test lamps having hybrid electrodes and containing a low dose mercury free volatile material

| Lamp | Xe (bar) | Volatile material |
|---|---|---|
| 13 | 6 | 1 mg $I_2$ |
| 14 | 6 | 1 mg $SnI_4$ |
| 15 | 6 | 1 mg $GaI_3$ |
| 16 | 6 | 1 mg $AlI_3$ |
| 17 | 6 | 1 mg $HfI_4$ |
| 18 | 6 | 1 mg $InI_3$ |
| 19 | 6 | 1 mg $ZnI_2$ |

These lamps were run-up at a current of 1 A until a power of 20 W could be obtained, at which time the power was maintained at 20 W. Because lamps 13-19 did not contain a suitable fill chemistry for steady state emission, they did not run particularly well. However, voltage measurements were taken during the operation of these lamps to get an indication of how the added volatile material affected initial voltage during run-up.

Figure 15:
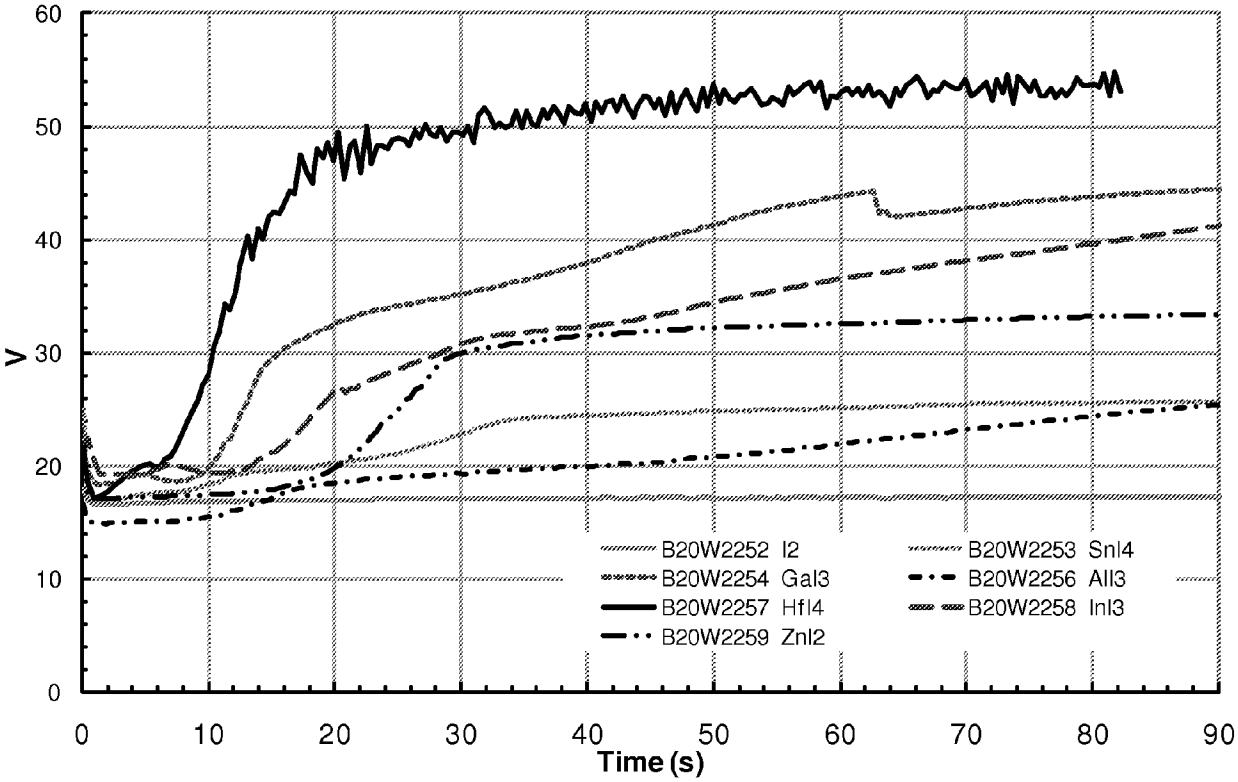
FIG. 15 is a plot of voltage vs. time for metal halide lamps containing at least one volatile material in accordance with the present disclosure, but no general metal halide fill chemistry.

FIG. 15 plots the voltage vs. time that was measured during the operation of lamps 13-19. As shown, $HfI_4$, $GaI_3$, and $InI_3$ provided the fastest and largest increases in voltage during initial run-up, and thus appeared to be promising volatile materials for addition to metal halide lamps.

Another group of experimental lamps was prepared having substantially the same construction as lamps 13-19. These lamps, however, contained 6 bar xenon, a small dose of a volatile material, and a fill chemistry suitable for steady state operation. The amount of volatile material added to each lamp was about one micromole. That dosage corresponded to the 1 micromole dosage of Hg that was found to be a favorable dose in other work. Table 4 lists the target compositions for this group of test lamps.

TABLE 4

Target compositions for 20 W test lamps having hybrid electrodes, and containing a low dose mercury free volatile material and suitable metal halide fill chemistry

| Lamp | Xe (bar) | Volatile Material | Fill Chemistry |
|---|---|---|---|
| 20 | 6 | 0.25 mg $I_2$ | 0.74 mg NaI; 1.34 mg $DyI_3$; 0.43 mg $CeI_3$ |
| 21 | 6 | 0.63 mg $SnI_4$ | 0.74 mg NaI; 1.34 mg $DyI_3$; 0.43 mg $CeI_3$ |
| 22 | 6 | 0.45 mg $GaI_3$ | 0.74 mg NaI; 1.34 mg $DyI_3$; 0.43 mg $CeI_3$ |
| 23 | 6 | 0.41 mg $AlI_3$ | 0.74 mg NaI; 1.34 mg $DyI_3$; 0.43 mg $CeI_3$ |
| 24 | 6 | 0.69 mg $HfI_4$ | 0.74 mg NaI; 1.34 mg $DyI_3$; 0.43 mg $CeI_3$ |
| 25 | 6 | 0.50 mg $InI_3$ | 0.74 mg NaI; 1.34 mg $DyI_3$; 0.43 mg $CeI_3$ |
| 26 | 6 | 0.32 mg $ZnI_2$ | 0.74 mg NaI; 1.34 mg $DyI_3$; 0.43 mg $CeI_3$ |

Figure 16:
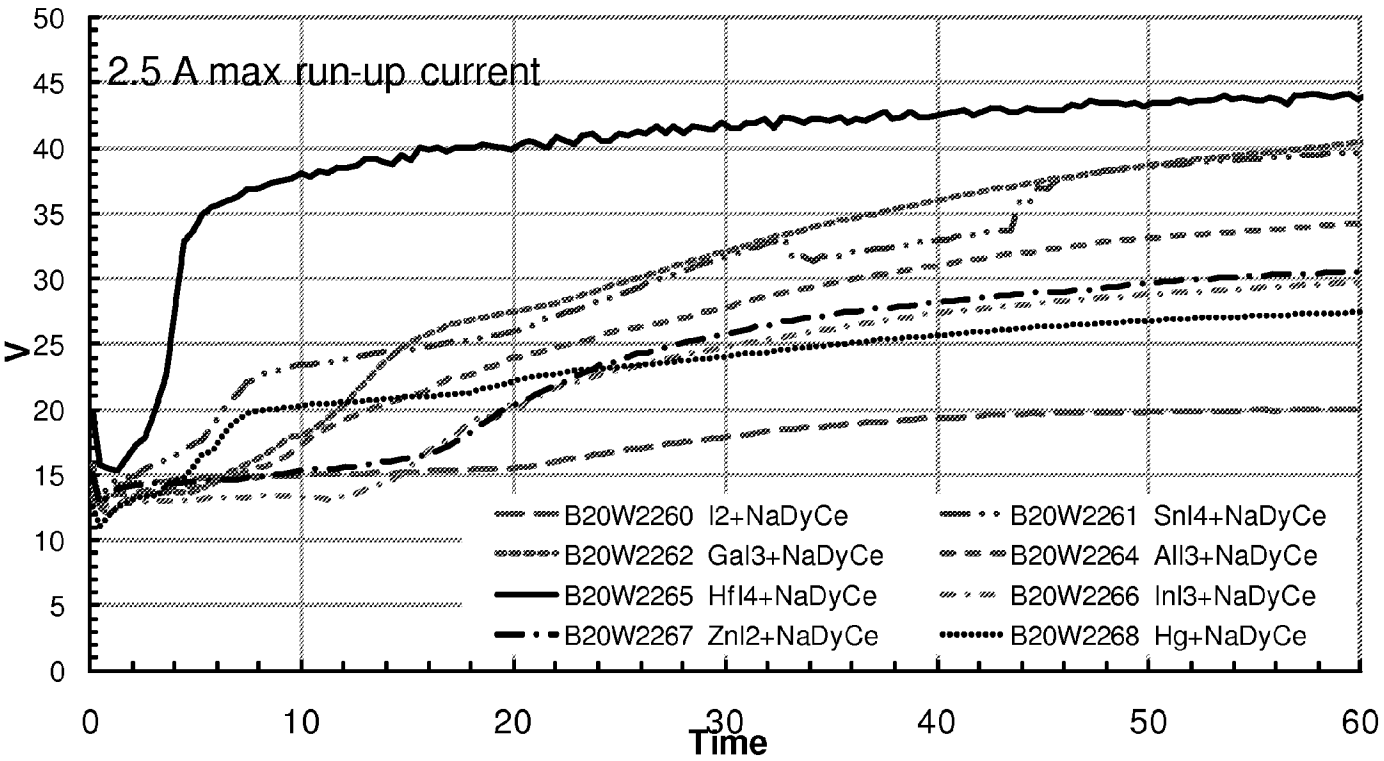
FIG. 16 is a plot of voltage vs. time for metal halide lamps containing at least one volatile material and a general metal halide fill chemistry in accordance with the present disclosure.

Lamps 20-26 were run-up using the constant current to full light output control method (previously described). A run-up current of 2.5 A was used. The voltage vs. time behavior for this second group of experimental lamps was measured, and is shown in FIG. 16. Also plotted for comparison in FIG. 16 is the corresponding data for a metal halide lamp containing 0.2 mg Hg as a volatile material. As shown, $HfI_4$, $SnI_4$, and $GaI_a$ provided the greatest increase in voltage during early run-up. The voltage "glitches" in the data curve for lamp 15 were believed to be due to a bimodal condensate distribution in the $SnI_4$ containing lamps.

Figure 17:
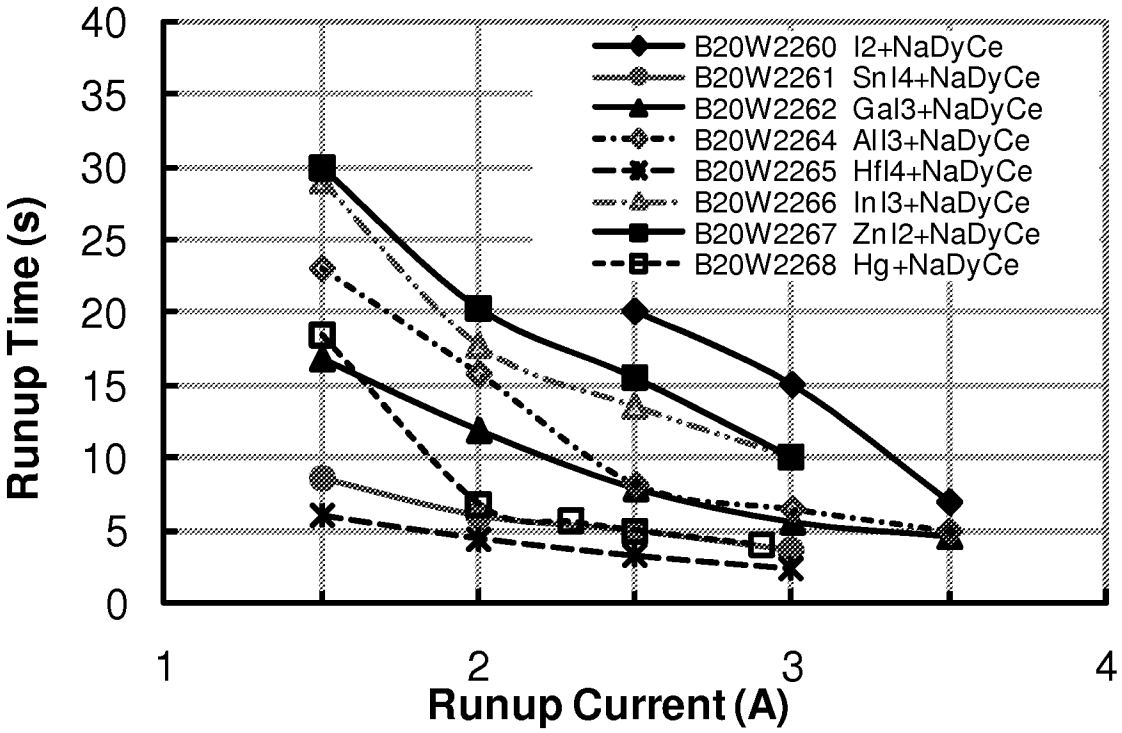
FIG. 17 is a plot of run-up time vs. run-up current for various metal halide lamps in accordance with the present disclosure.

Comparison of FIGS. 15 and 16 shows that the ranking of "voltage producing capability" of the volatile materials depended on the lamp group that was evaluated. For example, in the second group of lamps the voltage increase produced by $InI_3$ was exceeded by the voltage increase produced by $SnI_4$. This is different from the first group of lamps, where the opposite was observed. The run-up time vs. current for lamps 20-26 is plotted in FIG. 17. At 2.5 A, relatively fast run-up times of ≤15 seconds were observed in all of the lamps containing volatile metal halides. The lamps containing $HfI_4$, $SnI_3$, $GaI_3$, and $AlI_3$ all exhibited run-up times of less than 10 seconds at this run-up current.

Figure 18:
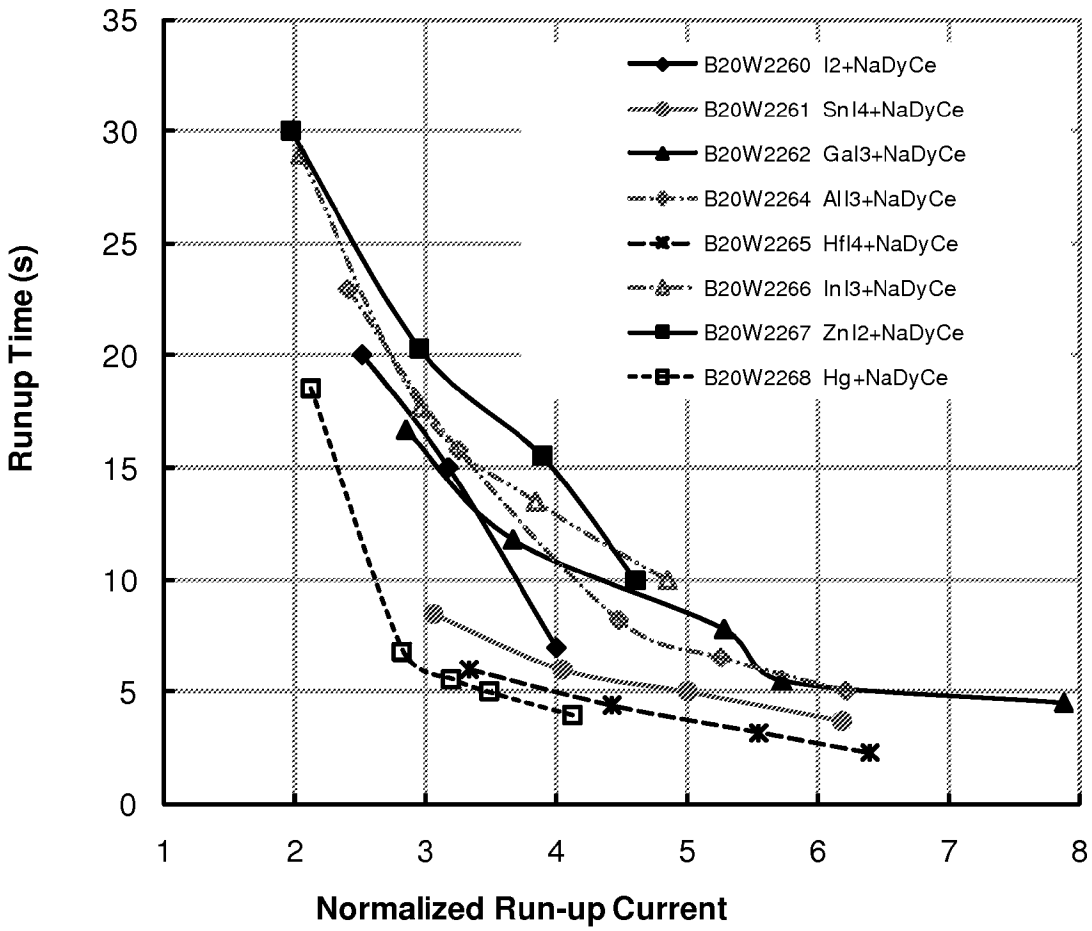
FIG. 18 is a plot of run-up time vs. normalized run-up current for various metal halide lamps in accordance with the present disclosure.

To evaluate how stressful the run-up current would be on an electrode optimized for steady state operation, the run-up currents utilized were normalized against the steady state current for each lamp. The resulting plot of run-up time vs. normalized run-up current (run-up current/steady state current) is given in FIG. 18. From prior testing, normalized run-up currents of up to about 4 are considered acceptable, with normalized run-up currents ranging from about 3 to about 4 being preferred. In the 3-4 range, relatively fast fun-up was obtained in lamps containing $HfI_4$ and $SnI_4$, but those lamps exhibited longer run-up time than what was observed in lamps containing an optimized (0.2 mg) dose of Hg.

From the data, it was expected that further optimization of the volatile metal halide dose would lead to further improvements in run-up time. For example, in the case of $SnI_4$, the "knee" in the plot of voltage vs. time in FIG. 16 indicates that the dose was evaporated at about 7 seconds, but the corresponding run-up time vs. run-up curve in FIG. 17 indicates that full light output was reached at about 5 s. This suggested that the dosage amount for $SnI_4$ in the tested lamp was excessive and may unnecessarily increase steady state voltage and thus, decrease steady state current. Decreasing the dose amount was expected to permit higher run-up current and hence, shorter run-up time. The impact of lower doses of volatile metal halides is described in the next example.

20 W Lamps with Hybrid Electrodes Containing 0.1-1 mg Doses of $HfI_4$, $GaI_a$ or $SnI_4$ Promising volatile metal halides ($HfI_4$, $GaI_a$, $SnI_4$) were selected for further study to determine optimum dose for accelerating run-up. In total, six lamps containing each type of metal halide were constructed using 20 W arc tubes containing hybrid electrode assemblies. While the feedthrough part of the electrode was typical of a 20 W or 35 W lamp, the tip size was more typical of that used in 70 W ceramic metal halide lamps. Because the electrode tips were conventionally used in a 70 W product with a $V_s$ of 90V, they had a current rating of 0.78 A. The electrodes were positioned with a targeted arc gap of 3 mm, and appropriately sealed.

The lamps were filled with a general metal halide fill for light emission, and a volatile metal halide for accelerating run-up. The dose amount of the volatile metal halide ranged from about 0.1 to 1.0 mg (about 0.25 to 1.5 micromoles). The lamp dosing in mg and micromoles is summarized below in Tables 5 and 6, respectively.

TABLE 5

Target compositions (in milligrams) for 20 W test lamps having hybrid electrodes, and containing 0.1-1 mg of $HfI_4$, $GaI_3$, or $SnI_4$ as a Volatile Material

| Lamp ID | $SnI_4$ (mg) | $GaI_3$ (mg) | $HfI_4$ (mg) | NaI (mg) | $DyI_3$ (mg) | $CeI_3$ (mg) | Xe (bar) |
|---|---|---|---|---|---|---|---|
| 27 | 0.598 | | | 0.687 | 1.323 | 0.434 | 6 |
| 28 | | 0.478 | | 0.689 | 1.346 | 0.446 | 6 |
| 29 | | | 0.694 | 0.694 | 1.329 | 0.412 | 6 |
| 30 | 0.322 | | | 0.844 | 1.129 | 0.538 | 6 |
| 31 | 0.172 | | | 0.844 | 1.131 | 0.547 | 6 |
| 32 | | 0.224 | | 0.845 | 1.131 | 0.537 | 6 |
| 33 | | 0.112 | | 0.825 | 1.121 | 0.536 | 6 |
| 34 | | | 0.340 | 0.833 | 1.127 | 0.538 | 6 |
| 35 | | | 0.166 | 0.846 | 1.135 | 0.551 | 6 |
| 36 | 0.453 | | | 0.804 | 1.140 | 0.530 | 6 |
| 37 | 0.634 | | | 0.863 | 1.130 | 0.535 | 6 |
| 38 | 0.927 | | | 0.826 | 1.142 | 0.523 | 6 |
| 39 | | 0.297 | | 0.827 | 1.142 | 0.583 | 6 |
| 40 | | 0.414 | | 0.828 | 1.130 | 0.569 | 6 |
| 41 | | 0.664 | | 0.820 | 1.136 | 0.503 | 6 |
| 42 | | | 0.508 | 0.819 | 1.115 | 0.534 | 6 |
| 43 | | | 0.690 | 0.842 | 1.144 | 0.512 | 6 |
| 44 | | | 1.012 | 0.837 | 1.139 | 0.584 | 6 |

TABLE 6

Target compositions (in micromoles) for 20 W test lamps having hybrid electrodes, and containing 0.1-1 mg of $HfI_4$, $GaI_3$, or $SnI_4$ as a Volatile Material

| Lamp ID | $SnI_4$ (μmol) | $GaI_3$ (μmol) | $HfI_4$ (μmol) | NaI (μmol) | $DyI_3$ (μmol) | $CeI_3$ (μmol) | Xe (bar) |
|---|---|---|---|---|---|---|---|
| 27 | 0.95 | | | 4.58 | 2.44 | 0.83 | 6 |
| 28 | | 1.06 | | 4.60 | 2.48 | 0.86 | 6 |
| 29 | | | 1.01 | 4.63 | 2.45 | 0.79 | 6 |
| 30 | 0.51 | | | 5.63 | 2.08 | 1.03 | 6 |
| 31 | 0.27 | | | 5.63 | 2.08 | 1.05 | 6 |
| 32 | | 0.50 | | 5.64 | 2.08 | 1.03 | 6 |
| 33 | | 0.25 | | 5.50 | 2.06 | 1.03 | 6 |
| 34 | | | 0.50 | 5.56 | 2.07 | 1.03 | 6 |
| 35 | | | 0.24 | 5.64 | 2.09 | 1.06 | 6 |
| 36 | 0.72 | | | 5.36 | 2.10 | 1.02 | 6 |
| 37 | 1.01 | | | 5.76 | 2.08 | 1.03 | 6 |
| 38 | 1.48 | | | 5.51 | 2.10 | 1.00 | 6 |
| 39 | | 0.66 | | 5.52 | 2.10 | 1.12 | 6 |
| 40 | | 0.92 | | 5.52 | 2.08 | 1.09 | 6 |
| 41 | | 1.47 | | 5.47 | 2.09 | 0.97 | 6 |
| 42 | | | 0.74 | 5.46 | 2.05 | 1.03 | 6 |
| 43 | | | 1.01 | 5.62 | 2.11 | 0.98 | 6 |
| 44 | | | 1.47 | 5.58 | 2.10 | 1.12 | 6 |

Figure 19:
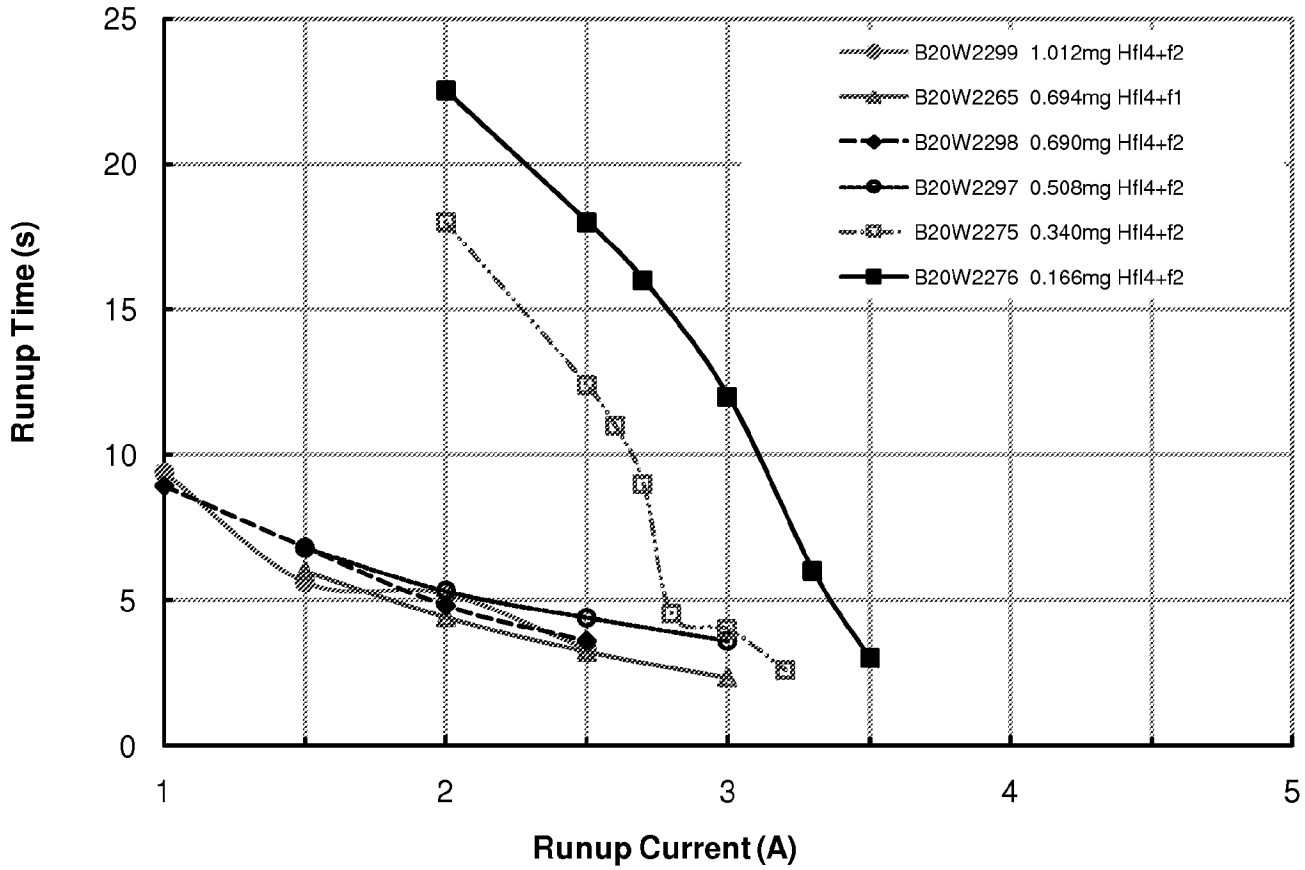
FIG. 19 is a plot of run-up time vs. run-up current for metal halide lamps containing low doses of $HfI_4$ in accordance with the present disclosure.
Figure 20:
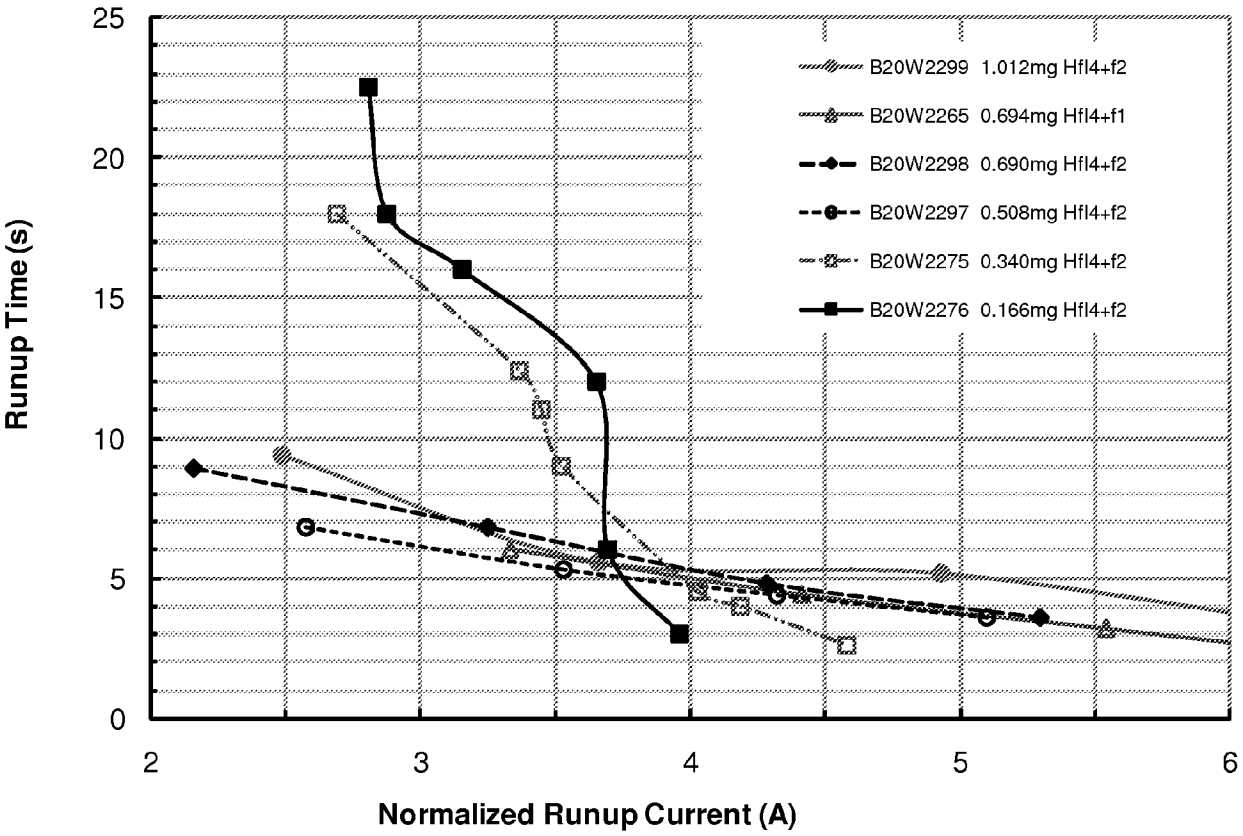
FIG. 20 is a plot of run-up time vs. normalized run-up current for metal halide lamps containing low doses of $HfI_4$ in accordance with the present disclosure.
Figure 21:
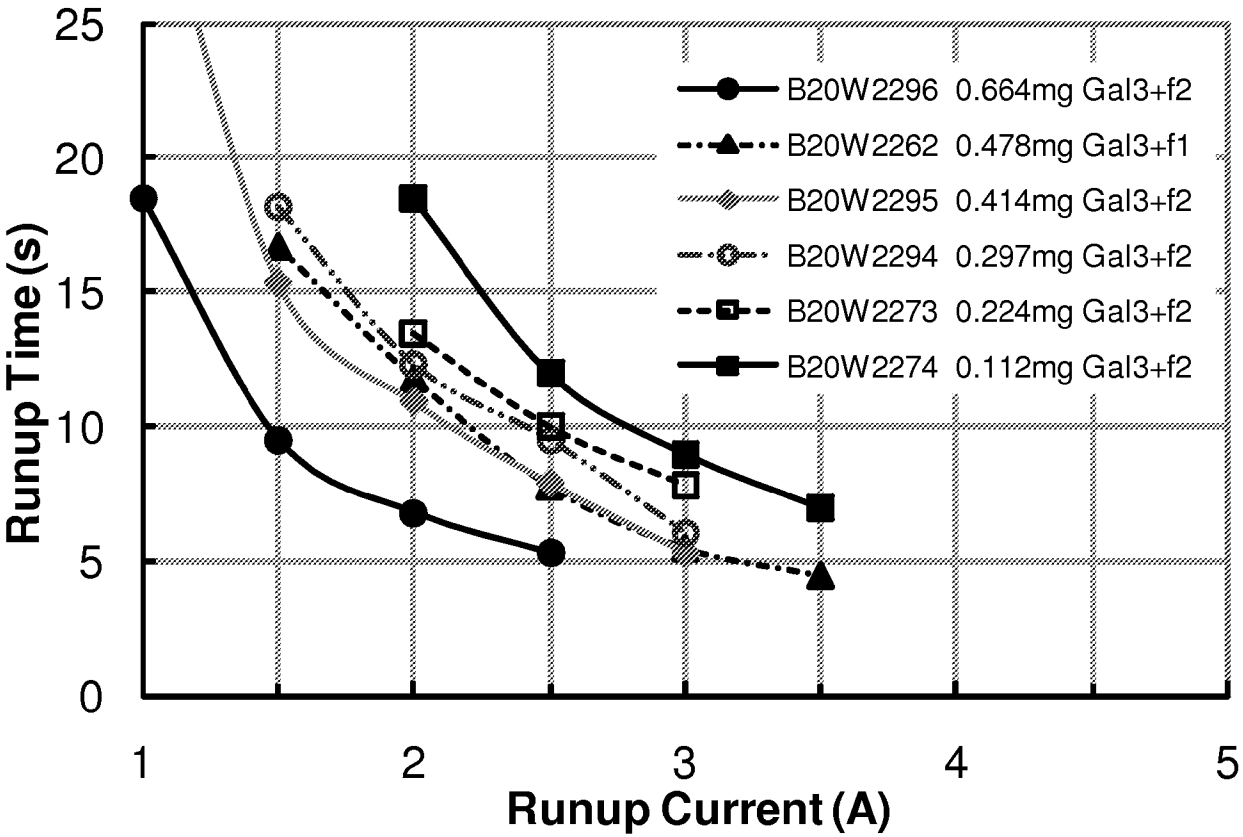
FIG. 21 is a plot of run-up time vs. run-up current for metal halide lamps containing low doses of $GaI_3$ in accordance with the present disclosure.
Figure 22:
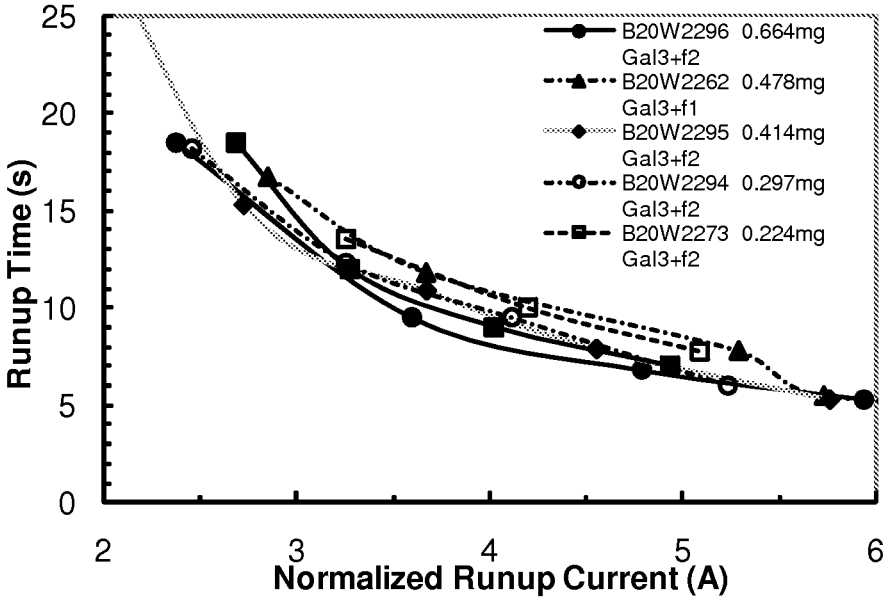
FIG. 22 is a plot of run-up time vs. normalized run-up current for metal halide lamps containing low doses of $GaI_3$ in accordance with the present disclosure.

The lamps were run in vertical orientation at various run-up currents ranging from 1 A to 3.5 A, i.e., 2-6 times the steady state current. Plots of run-up time vs. absolute and normalized run-up current for the lamps containing $HfI_4$ are shown in FIGS. 19 and 20, respectively. Similar data for the lamps containing $GaI_3$ is plotted in FIGS. 21 and 22.

The run-up time corresponding to 3 times the steady state current of the tested lamps was interpolated from each of the gathered data runs. These run-up times are plotted in FIG. 23, with run-up time correlating to the time required to reach full light output (at 3 times the steady state current), and each data point corresponding to one lamp. Also plotted for comparison is the equivalent data for the low dose Hg lamps described previously.

Figure 23:
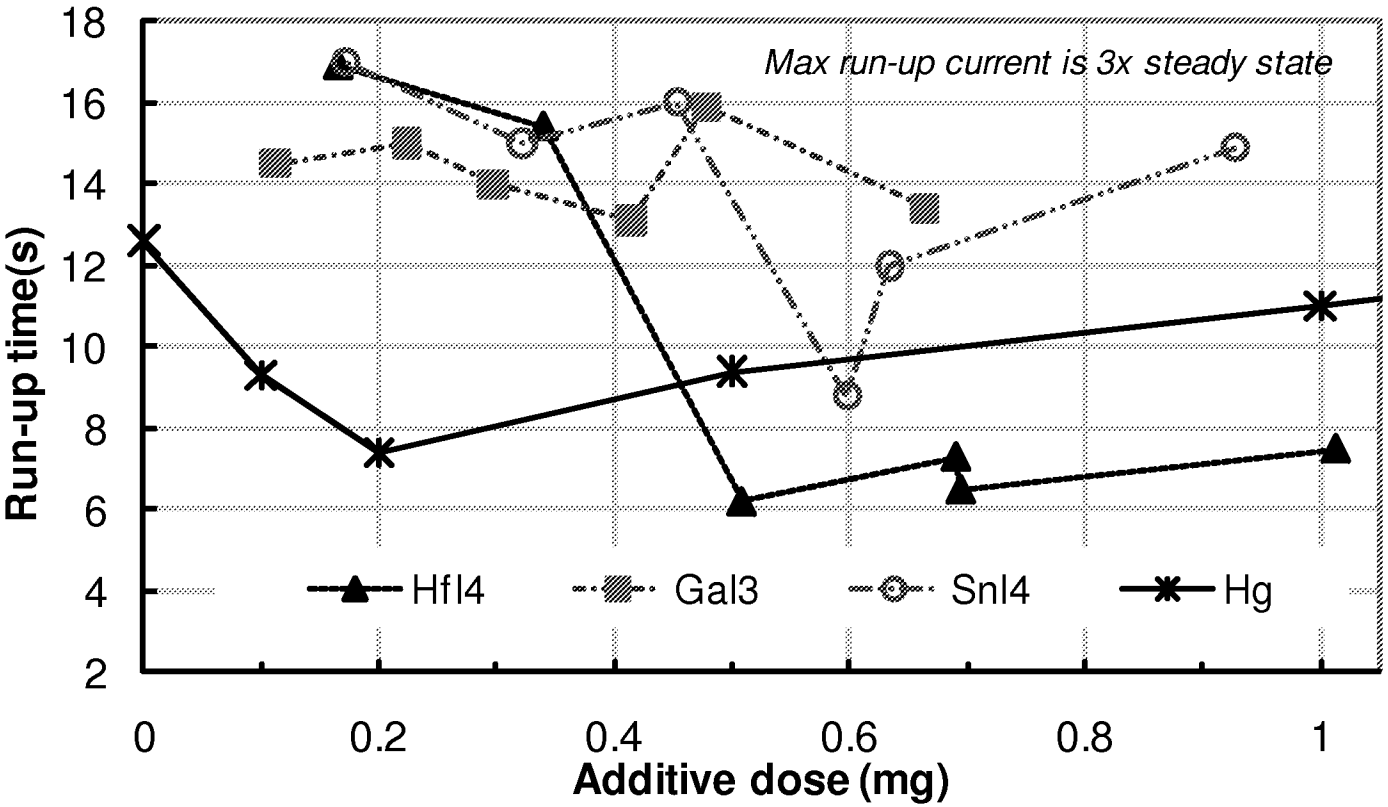
FIG. 23 is a plot of run-up time vs. additive dose for metal halide lamps containing various volatile materials in accordance with the present disclosure.
Figure 24:
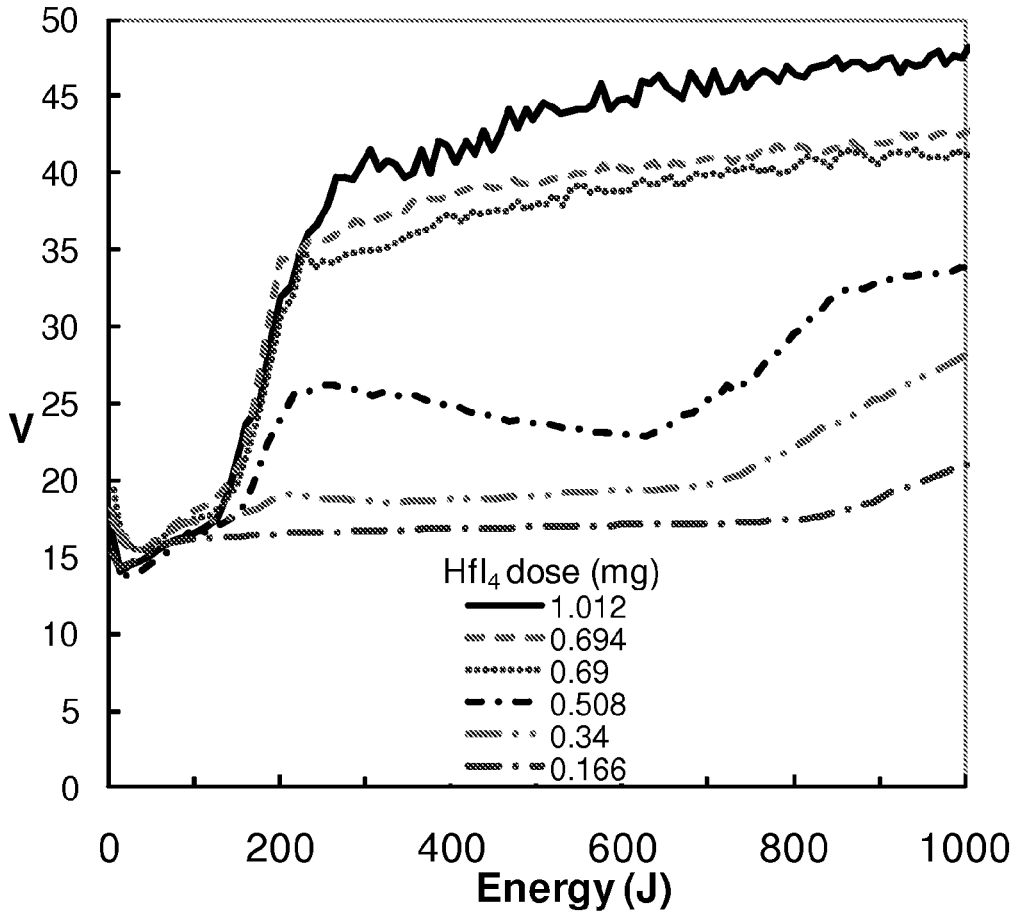
FIG. 24 is a plot of voltage vs. energy for metal halide lamps containing varying amounts of $HfI_4$ as a volatile material in accordance with the present disclosure.

As shown in FIG. 23, the impact of dose on run-up time varied between the tested volatile metal halides. In the case of $HfI_4$, the impact of dose on run-up time was similar to that of the previously described Hg-containing lamps, in that $HfI_4$ appeared to behave relatively independently of the main metal halide fill. The rise in vapor pressure vs. energy is believed to be relatively independent of dose amount, since the observed voltage vs. energy in those lamps (FIG. 2) was relatively independent of dose amount, with voltage vs. energy for differently dosed lamps overlapping during early run-up.

Figure 25:
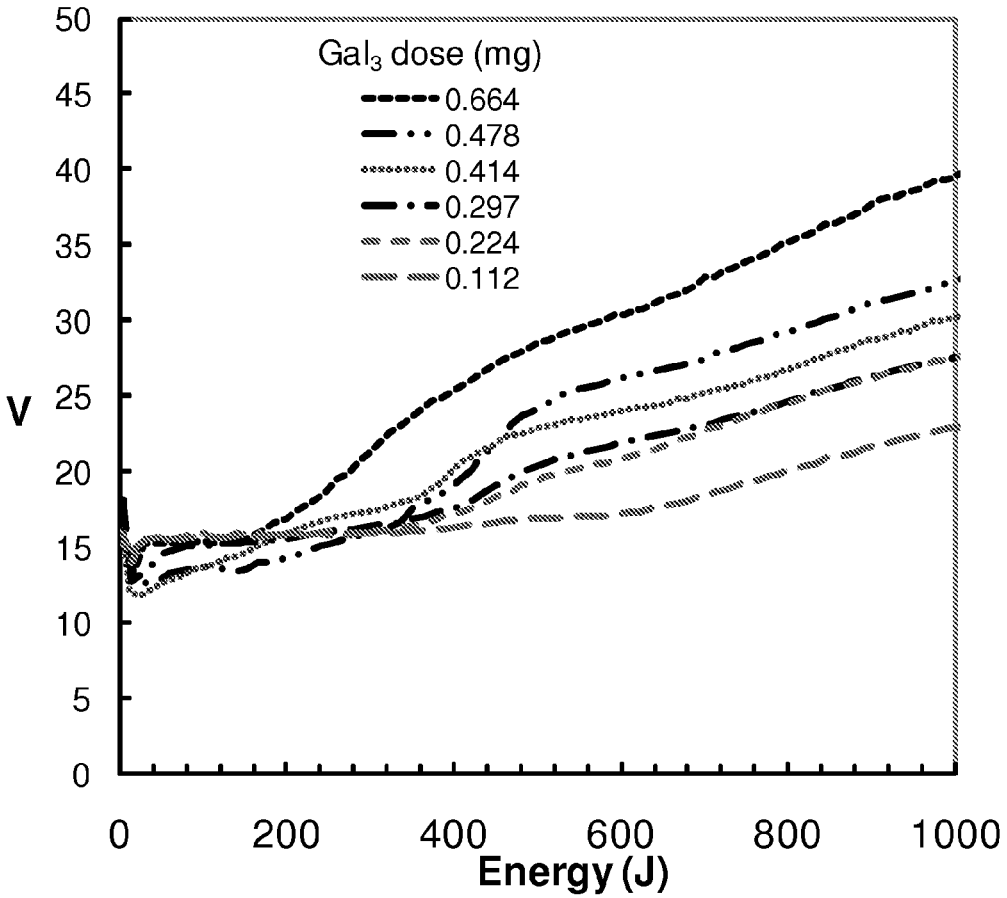
FIG. 25 is a plot of voltage vs. energy for metal halide lamps containing varying amounts of $GaI_3$ as a volatile material in accordance with the present disclosure.

In contrast, the voltage vs. energy curves observed in lamps containing varying doses of $GaI_3$ (FIG. 25), generally did not overlap. Lamps dosed with increased amounts of $GaI_3$ also exhibited higher voltages during run-up. Overall, the run-up for the lamps containing $GaI_3$ was not as fast as with other volatile materials such as Hg or $HfI_4$. Nonetheless, $GaI_3$ could be a desirable alternative when the use of Hg or $HfI_4$ is not desirable. In addition, the relative insensitivity of run-up time to dose amount observed in the $GaI_3$ containing lamps allows some flexibility in adjusting the steady state voltage.

Figure 26:
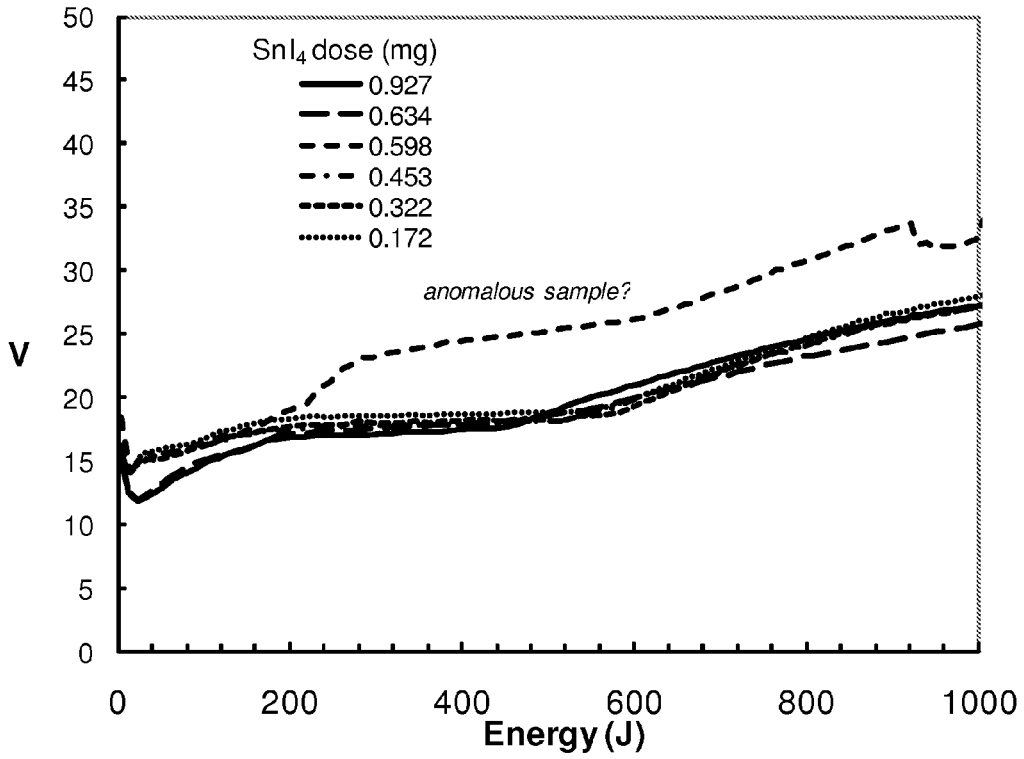
FIG. 26 is a plot of voltage vs. energy for metal halide lamps containing varying amounts of $SnI_4$ as a volatile material in accordance with the present disclosure.
Figure 27:
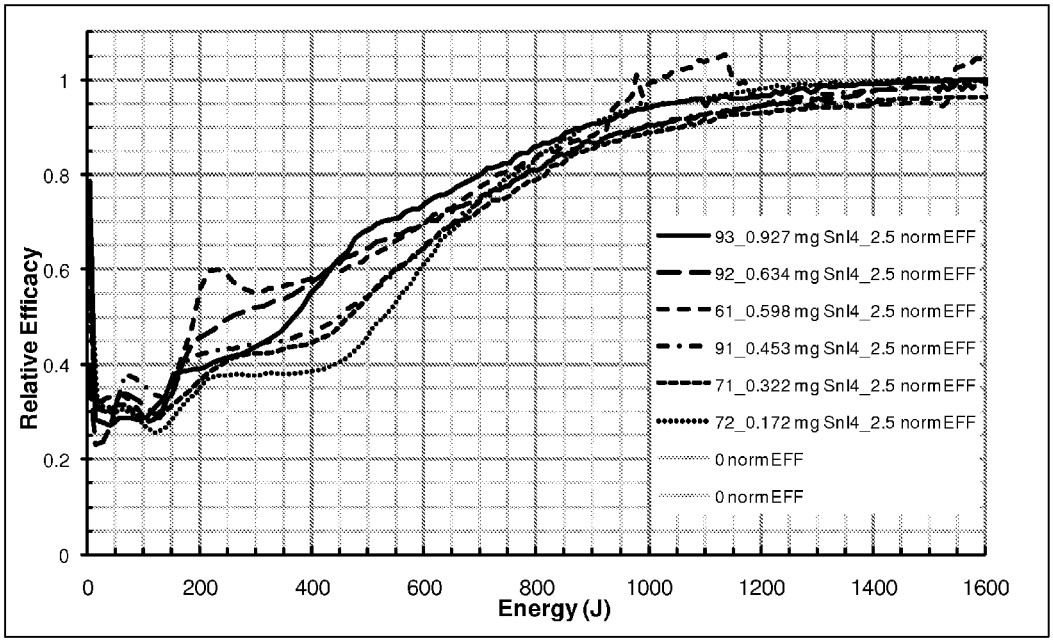
FIG. 27 is a plot of relative efficacy vs. energy for metal halide lamps containing varying amounts of $SnI_4$ as a volatile material in accordance with the present disclosure.

FIG. 26 is a plot of voltage vs. energy for the lamps containing varying amounts of $SnI_4$ as a volatile material. As shown, the voltage during run-up and steady state does not seem to be affected by dosage amount (the lamp containing 0.598 g of $SnI_4$ being considered an anomalous sample). Thus, if $SnI_4$ affected the vapor pressure of any species, those species did not appear to impact voltage at any point during run-up. The lamps containing $SnI_4$ doses of about 0.6 mg showed slightly improved relative efficacy during run-up (FIG. 27), which corresponded to a weak minima observed in the run-up time vs. dose curve (FIG. 23) generated from $SnI_4$-containing lamps.

As described above and as demonstrated by the test data, metal halide lamps containing low doses of a volatile material can exhibit several advantages, such as accelerated run-up to full light output, significant instant light output, long life for general lighting applications, and adequate long term lumen maintenance, particularly when coupled with hybrid electrodes that can tolerate increased run-up current. Moreover, such lamps can be mercury free.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A metal halide lamp, comprising:

a discharge vessel comprising a discharge space;

at least one electrode assembly extending into the discharge vessel in a sealed fashion to be in contact with the discharge space, the at least one electrode assembly comprising an electrode tip having a nominal steady state current rating (in amperes) greater than or equal to about P/50V, where P is the lamp nominal, steady state power (in volt*amps);

at least one fill gas in the discharge space; and at least one fill material in the discharge space, the fill material comprising at least one first metal halide.

2. The metal halide lamp of claim 1, wherein the current rating is greater than or equal to about P/40V.

3. The metal halide lamp of claim 2, wherein the current rating is greater than or equal to about P/30V.

4. The metal halide lamp of claim 1, further comprising at least one volatile material other than the fill material in the discharge space.

5. The metal halide lamp of claim 4, wherein the at least one volatile material is selected from the group consisting of mercury, at least one second metal halide, and combinations thereof.

6. The metal halide lamp of claim 4, wherein the at least one volatile material comprises mercury in an amount ranging from greater than 0 to about 20 mg/cc.

7. The metal halide lamp of claim 4, wherein the at least one volatile material comprises at least one second metal halide, wherein the at least one second metal halide has a higher vapor pressure than the at least one first metal halide.

8. The metal halide lamp of claim 7, wherein the at least one second metal halide is selected from the group consisting of $SnI_4$, $GaI_3$, $AlI_3$, $HfI_4$, $InI_3$, $ZnI_2$ and combinations thereof.

9. The metal halide lamp of claim 8, wherein the at least one volatile material is present in an amount ranging from greater than 0 to about 20 mg/cc.

10. An apparatus, comprising:

a metal halide lamp, the metal halide lamp comprising:

a discharge vessel comprising a discharge space;

at least one electrode assembly extending into the discharge vessel in a sealed fashion to be in contact with the discharge space, the at least one electrode assembly comprising an electrode tip and a feedthrough, the electrode tip having a current rating $C_1$;

at least one fill gas in the discharge space;

at least one fill material in the discharge space, the fill material comprising at least one first metal halide; and at least one volatile material other than the fill material in the discharge space, wherein the at least one volatile material has a higher vapor pressure than the at least one first metal halide wherein:

the metal halide lamp has a first voltage $V_i$ at ignition, a power $P_{req}$, a second voltage $V_s$, and a current $I_s$ during steady state operation;

$$P_{req}=V_s*I_s;$$

$V_s/V_i$ is less than or equal to about 3.33; and the electrode tip is sized or otherwise configured such that $C_1$ is greater than or equal to $I_s$.

11. The apparatus of claim 10, wherein the at least one volatile material is selected from the group consisting of mercury, at least one second metal halide, and combinations thereof.

12. The apparatus of claim 11, wherein the at least one volatile material comprises mercury in an amount ranging from greater than 0 to about 20 mg/cc.

13. The apparatus of claim 12, wherein the at least one volatile material comprises mercury in an amount ranging from greater than 0 to about 4 mg/cc.

14. The apparatus of claim 11, wherein the at least one volatile material comprises at least one second metal halide.

15. The apparatus of claim 14, wherein the at least one second metal halide is selected from the group consisting of $SnI_4$, $GaI_3$, $AlI_3$, $HfI_4$, $InI_3$, $ZnI_2$ and combinations thereof.

16. The apparatus of claim 15, wherein the at least one second metal halide is chosen from $HfI_4$, $GaI_3$, $SnI_4$, and combinations thereof.

17. The apparatus of claim 15, wherein the at least one second metal halide is present in an amount ranging from greater than 0 to about 20 mg/cc.

18. A metal halide lamp, comprising:

a discharge vessel comprising a discharge space;

at least one electrode assembly extending into the discharge vessel in a sealed fashion to be in contact with the discharge space, the at least one electrode assembly comprising an electrode tip and a feedthrough, the electrode tip having a current rating $C_1$;

at least one fill gas in the discharge space; and at least one fill material in the discharge space, the fill material comprising at least one first metal halide;

at least one volatile material in the discharge space, the at least one volatile material being selected from the group consisting of mercury, at least one second metal halide having a higher vapor pressure than the first metal halide, and combinations thereof wherein:

the metal halide lamp has a first voltage $V_i$ at ignition, a power $P_{req}$, a second voltage $V_s$, and a current $I_s$ during steady state operation;

$$P_{req}=V_s*I_s;$$

$V_s/V_i$ is less than or equal to about 3.33; and the electrode tip is sized or otherwise configured such that $C_1$ is greater than or equal to $I_s$.

19. The metal halide lamp of claim 18, wherein $V_s/V_i$ is less than or equal to about 2.5.

20. The metal halide lamp of claim 18, wherein $V_s/V_i$ is less than or equal to about 2.

21. A method of operating a metal halide lamp comprising:

providing a metal halide lamp comprising:

a discharge vessel comprising a discharge space;

at least one electrode assembly extending into the discharge vessel in a sealed fashion to be in contact with the discharge space, the at least one electrode assembly comprising an electrode tip and a feedthrough, the electrode tip having a current rating $C_1$;

at least one fill gas in the discharge space; and at least one fill material in the discharge space, the fill material comprising at least one first metal halide;

at least one volatile material in the discharge space, the at least one volatile material being selected from the group consisting of mercury, at least one second metal halide having a higher vapor pressure than the first metal halide, and combinations thereof; wherein:

the metal halide lamp has a first voltage $V_i$ at ignition, a power $P_{req}$, a second voltage $V_s$, and a current $I_s$ during steady state operation;

$$P_{req}=V_s*I_s;$$

$V_s/V_i$ is less than or equal to about 3.33; and the electrode tip is sized or otherwise configured such that $C_1$ is greater than or equal to about $I_s$;

igniting the metal halide lamp;

running up the metal halide lamp to steady state operation; and maintaining the metal halide lamp at steady state operation by applying $P_{req}$ to the at least one electrode assembly.

22. The method of claim 21, further comprising applying a fixed or variable run-up current $I_r$ that is about 1 to about 5 times $I_s$ during the running up, and sizing or otherwise configuring the electrode assembly to have a current carrying capacity sufficient to withstand $I_r$ during the running up.

* * * * *